US012123124B2

(12) United States Patent
Chang et al.

(10) Patent No.: US 12,123,124 B2
(45) Date of Patent: Oct. 22, 2024

(54) WASHING MACHINE AND CONTROLLING METHOD THEREOF

(71) Applicant: Samsung Electronics Co., Ltd., Suwon-si (KR)

(72) Inventors: Seokmo Chang, Suwon-si (KR); Junhyun Park, Suwon-si (KR); Jeonghoon Kang, Suwon-si (KR); Sungmo Lee, Suwon-si (KR); Suhwan Ji, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 16 days.

(21) Appl. No.: 16/947,115

(22) Filed: Jul. 17, 2020

(65) Prior Publication Data

US 2021/0017686 A1 Jan. 21, 2021

(30) Foreign Application Priority Data

Jul. 18, 2019 (KR) ..... 10-2019-0087201

(51) Int. Cl.
*D06F 33/43* (2020.01)
*D06F 23/06* (2006.01)
(Continued)

(52) U.S. Cl.
CPC ..... *D06F 33/43* (2020.02); *D06F 23/06* (2013.01); *D06F 33/74* (2020.02); *D06F 34/04* (2020.02);
(Continued)

(58) Field of Classification Search
CPC ..... D06F 33/43; D06F 23/06; D06F 33/74; D06F 34/04; D06F 34/18; D06F 34/24;
(Continued)

(56) References Cited

U.S. PATENT DOCUMENTS 8,919,154 B2 12/2014 Kim et al.
8,997,290 B2 4/2015 Kim et al.
(Continued)

FOREIGN PATENT DOCUMENTS

CN 1807746 A 7/2006
CN 102597355 A 7/2012
(Continued)

OTHER PUBLICATIONS

International Search Report dated Nov. 5, 2020 in connection with International Patent Application No. PCT/KR2020/009467, 3 pages.
(Continued)

*Primary Examiner* — Benjamin L Osterhout

(57) ABSTRACT

A washing machine and a method for controlling thereof. A washing machine including a spin basket, the washing machine including a driving unit configured to rotate the spin basket, a sensor configured to detect an operation of the washing machine, a display configured to display information, and a processor configured to, based on a user command for managing the washing machine being received, perform a cleaning course for cleaning the spin basket, obtain diagnosis information regarding the washing machine using the sensor while the cleaning course is performed, and display the obtained diagnosis information on the display. The processor is configured to perform the cleaning course by controlling the driving unit to supply wash water to the spin basket and rotate the spin basket filled with the wash water.

20 Claims, 17 Drawing Sheets

(51) Int. Cl.

| | |
|---|---|
| ***D06F 33/74*** | (2020.01) |
| ***D06F 34/04*** | (2020.01) |
| ***D06F 34/18*** | (2020.01) |
| ***D06F 34/24*** | (2020.01) |
| ***D06F 34/28*** | (2020.01) |
| *D06F 33/47* | (2020.01) |
| *D06F 34/05* | (2020.01) |
| *D06F 34/16* | (2020.01) |
| *D06F 101/20* | (2020.01) |
| *D06F 103/00* | (2020.01) |
| *D06F 103/04* | (2020.01) |
| *D06F 103/14* | (2020.01) |
| *D06F 103/16* | (2020.01) |
| *D06F 103/18* | (2020.01) |
| *D06F 103/24* | (2020.01) |
| *D06F 103/26* | (2020.01) |
| *D06F 105/54* | (2020.01) |
| *D06F 105/58* | (2020.01) |

(52) U.S. Cl.
CPC ..... *D06F 34/18* (2020.02); *D06F 34/24* (2020.02); *D06F 34/28* (2020.02); *D06F 33/47* (2020.02); *D06F 34/05* (2020.02); *D06F 34/16* (2020.02); *D06F 2101/20* (2020.02); *D06F 2103/00* (2020.02); *D06F 2103/04* (2020.02); *D06F 2103/14* (2020.02); *D06F 2103/16* (2020.02); *D06F 2103/18* (2020.02); *D06F 2103/24* (2020.02); *D06F 2103/26* (2020.02); *D06F 2105/54* (2020.02); *D06F 2105/58* (2020.02)

(58) Field of Classification Search
CPC .. D06F 34/28; D06F 2103/04; D06F 2103/14; D06F 2103/16; D06F 2103/18; D06F 2103/24; D06F 2105/54; D06F 33/47; D06F 34/05; D06F 34/16; D06F 2101/20; D06F 2103/00; D06F 2103/26; D06F 2105/58; D06F 34/14; D06F 34/20; D06F 39/087; D06F 2105/60
See application file for complete search history.

(56) References Cited

U.S. PATENT DOCUMENTS

| | | | |
|---|---|---|---|
| 9,062,407 | B2 | 6/2015 | Kim et al. |
| 9,121,125 | B2 | 9/2015 | Kim et al. |
| 9,222,210 | B2 | 12/2015 | Lee et al. |
| 9,558,653 | B2 | 1/2017 | Ha et al. |
| 9,764,363 | B2 | 9/2017 | Zhang et al. |
| 2006/0156766 | A1 | 7/2006 | Ioku |
| 2008/0216250 | A1 | 9/2008 | Lee et al. |
| 2008/0245113 | A1 | 10/2008 | Kim |
| 2011/0099727 | A1 | 5/2011 | Kim et al. |
| 2011/0099728 | A1 | 5/2011 | Kim et al. |
| 2011/0100070 | A1 | 5/2011 | Kim et al. |
| 2011/0252577 | A1 | 10/2011 | Kim et al. |
| 2011/0277513 | A1 | 11/2011 | Oak et al. |
| 2012/0160269 | A1 | 6/2012 | Pyo et al. |
| 2013/0145562 | A1 | 6/2013 | Lee et al. |
| 2014/0299164 | A1 | 10/2014 | Zhang et al. |
| 2014/0366588 | A1 | 12/2014 | Kim et al. |
| 2017/0241060 | A1 | 8/2017 | Seong et al. |
| 2018/0057991 | A1 | 3/2018 | Bae et al. |
| 2019/0032267 | A1 | 1/2019 | Kwon et al. |

FOREIGN PATENT DOCUMENTS

| | | | | | |
|---|---|---|---|---|---|
| CN | 102733151 | A | | 10/2012 | |
| CN | 103147254 | A | | 6/2013 | |
| EP | 1645674 | A1 | | 4/2006 | |
| EP | 3412822 | A1 | | 12/2018 | |
| JP | 2003-079988 | A | | 3/2003 | |
| JP | 2007-319184 | A | | 12/2007 | |
| JP | 2009-034257 | A | | 2/2009 | |
| JP | 2016043171 | A | * | 4/2016 | ..... D06F 25/00 |
| JP | 2018050909 | A | * | 4/2018 | |
| KR | 20-0279510 | Y1 | | 6/2002 | |
| KR | 10-2008-0068449 | A | | 7/2008 | |
| KR | 10-1059910 | B1 | | 8/2011 | |
| KR | 10-2011-0116794 | A | | 10/2011 | |
| KR | 10-2014-0122107 | A | | 10/2014 | |
| KR | 10-2017-0033685 | A | | 3/2017 | |
| KR | 10 20170033685 | | * | 3/2017 | |
| KR | 10-2018-0101412 | A | | 9/2018 | |
| KR | 10-2018-0101413 | A | | 9/2018 | |
| WO | 2015161667 | A1 | | 10/2015 | |
| WO | 2017135602 | A1 | | 8/2017 | |

OTHER PUBLICATIONS

Written Opinion of the International Searching Authority dated Nov. 5, 2020 in connection with International Patent Application No. PCT/KR2020/009467, 7 pages.
Supplementary European Search Report dated May 16, 2022, in connection with European Application No. 20841182.7, 9 pages.
Communication pursuant to Article 94(3) EPC dated May 15, 2023, in connection with European Application No. 20841182.7, 3 pages.
The First Office Action dated Aug. 11, 2023, in connection with Chinese Patent Application No. 202080043800.5, 25 pages.
Request for the Submission of an Opinion dated Jul. 8, 2024, in connection with Korean Patent Application No. 10-2019-0087201, 13 pages.

* cited by examiner

FIG. 8

810

Device ID : 508a3daa-1396-d35e-ffaf-e0599d20571d / Installation date : 2017.11.15

| Date [yy.mm.dd] | Time | HOT WATER FLOW RATE [LPM] | EMPTY TUB WEIGHT DETECTION | DRAINAGE MEASUREMENT | MOST FREQUENTLY USED COURSE | Error Code | DOOR CHECK |
|---|---|---|---|---|---|---|---|
| 2017.11.15 | 08:47 A.M. | 12.78 | 161 | 12.78 | Normal | A7 | OFF |
| 2017.12.05 | 09:17 A.M. | 12.81 | 158 | 12.81 | Normal | A7 | OFF |
| 2018.01.30 | 02:35 P.M. | 12.76 | 157 | 12.76 | Normal | A7 | OFF |
| 2018.03.01 | 03:49 P.M. | 12.45 | 156 | 12.45 | Normal | A7 | OFF |
| 2018.05.05 | 02:11 P.M. | 12.21 | 158 | 12.21 | Normal | A7 | OFF |
| 2018.06.30 | 10:01 A.M. | 12.31 | 154 | 12.31 | Normal | A7 | OFF |
| 2018.07.01 | 11:34 A.M. | 12.05 | 153 | 12.05 | Normal | A7 | OFF |
| 2018.08.23 | 10:42 A.M. | 11.88 | 152 | 11.88 | Normal | A7 | OFF |
| 2018.09.22 | 12:42 P.M. | 11.82 | 151 | 11.82 | Normal | A7 | OFF |
| 2018.10.31 | 11:53 A.M. | 11.76 | 162 | 11.76 | Normal | A7 | OFF |
| 2018.11.19 | 10:47 A.M. | 11.56 | 160 | 11.56 | Normal | A7 | OFF |

820 830 840 850 860 870 880

WASHING MACHINE AND CONTROLLING METHOD THEREOF

CROSS-REFERENCE TO RELATED APPLICATION

This application is based on and claims priority under 35 U.S.C. § 119 to Korean Patent Application No. 10-2019-0087201, filed on Jul. 18, 2019, in the Korean Intellectual Property Office, the disclosure of which is incorporated by reference herein in its entirety.

BACKGROUND

1. Field

The disclosure relates to a washing machine and a controlling method thereof, and more particularly a washing machine providing cleaning and management functions and a controlling method thereof.

2. Description of the Related Art

A washing machine is a machine which washes laundry such as clothes, towels, blankets, sheets, and the like clean by removing contaminants from the laundry.

However, in the washing machine, a detergent used for the washing or contaminants removed from the laundry may remain or bacteria or mold may grow. Accordingly, the washed laundry may not be washed clean and may be contaminated more than before, thereby risking user's health.

In order to prevent this, the washing machine may perform a cleaning function for cleaning the inside thereof. However, there is a problem regarding inefficient energy consumption in the process of performing the cleaning function, since the laundry may not be washed while performing the cleaning function, energy higher than the energy (e.g., water, electric power, time, and the like) consumed when performing the washing function for washing the laundry is consumed, and the cleaning function is required to be performed periodically.

In addition, the washing machine has a problem regarding a deterioration of functions of the washing machine or a damage on a specific part of the washing machine according to the number of times of usage or elapse of time, because the washing machine performs a series of mechanical operations such as supplying and draining wash water by opening and closing a valve, rotating a spin basket using a motor, and the like.

SUMMARY

In accordance with an aspect of the disclosure, there is provided a washing machine including a spin basket, the washing machine including a driving unit configured to rotate the spin basket, a sensor configured to detect an operation of the washing machine, a display displaying information, and a processor configured to, based on a user command for managing the washing machine being received, perform a cleaning course for cleaning the spin basket, obtain diagnosis information regarding the washing machine using the sensor while performing the cleaning course, and display the obtained diagnosis information on the display, in which the processor is configured to perform the cleaning course by controlling the driving unit to supply the wash water to the spin basket and rotate the spin basket filled with the wash water.

In accordance with another aspect of the disclosure, there is provided a method for controlling a washing machine including a spin basket, the method including, based on a user command for managing the washing machine being received, performing a cleaning course for cleaning the spin basket, obtaining diagnosis information regarding the washing machine using a sensor of the washing machine while performing the cleaning course, and displaying the obtained diagnosis information on the display, in which the performing a cleaning course includes supplying wash water to the spin basket and rotating the spin basket filled with the wash water.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 8 illustrates a view for explaining diagnosis information according to an embodiment;

DETAILED DESCRIPTION

Figure 1A:
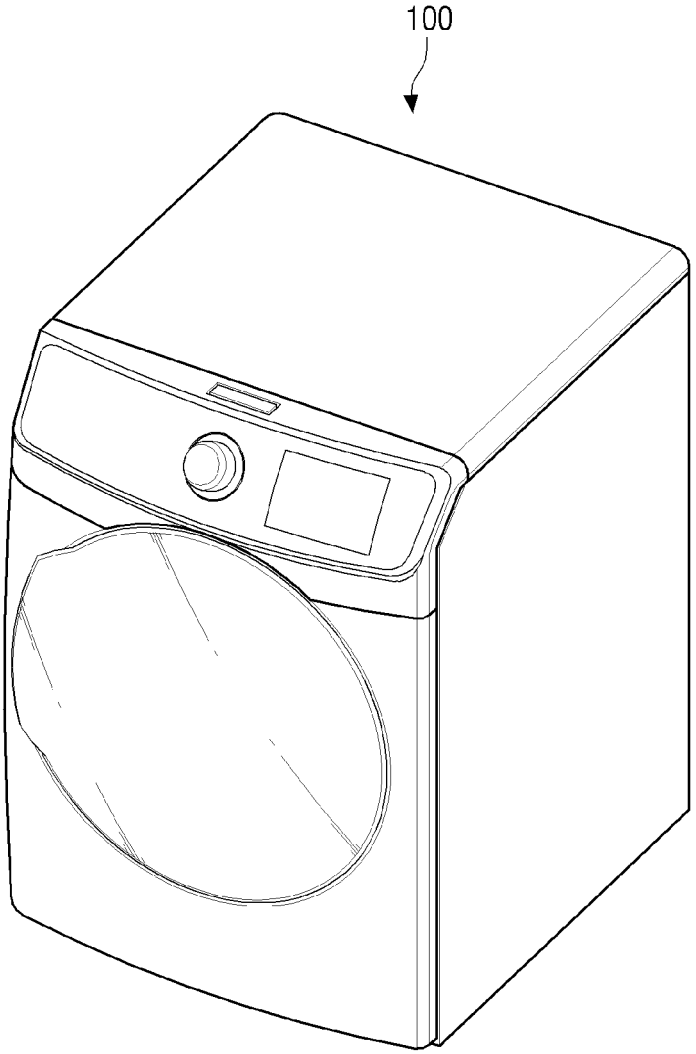
FIG. 1A illustrates a view for explaining a washing machine according to an embodiment.

FIGS. 1A through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

An object of the disclosure is to provide a washing machine which performs self-diagnosis while maintaining the inside of the washing machine clean, and a method for controlling the same.

In describing the disclosure, a detailed description of the related art or configuration is omitted when it is determined that the detailed description may unnecessarily obscure a gist of the disclosure. In addition, the embodiments below may be changed in various forms and the scope of the technical idea of the disclosure is not limited to the embodiments below. The embodiments are provided to complete the disclosure and completely transfer the technical idea of the disclosure to those skilled in the art.

It should be noted that the technologies disclosed in this disclosure are not for limiting the scope of the disclosure to a specific embodiment, but they should be interpreted to include all modifications, equivalents and/or alternatives of the embodiments of the disclosure. In relation to explanation of the drawings, similar reference numerals may be used for similar elements.

The expressions "first," "second" and the like used in the disclosure may denote various elements, regardless of order and/or importance, and may be used to distinguish one element from another, and does not limit the elements.

In this disclosure, expressions such as "A or B", "at least one of A [and/or] B,", or "one or more of A [and/or] B," include all possible combinations of the listed items. For example, "A or B", "at least one of A and/or B,", or "at least one or more of A and/or B" may be interpreted to include any of (1) A, (2) B, or (3) A and B, unless otherwise noted, and other elements may also be further included in this case.

In the disclosure, unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

If it is described that a certain element (e.g., first element) is "operatively or communicatively coupled with/to" or is "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and the another element.

Also, the expression "configured to" used in the disclosure may be interchangeably used with other expressions such as "suitable for," "having the capacity to," "designed to," "adapted to," "made to," and "capable of," depending on cases. The expression "configured to (or set to)" does not necessarily refer to a device being "specifically designed to" in terms of hardware. Instead, under some circumstances, the expression "a device configured to" may refer to the device being "capable of" performing an operation together with another device or component. For example, the phrase "a processor configured (or set) to perform A, B, and C" may refer, for example, and without limitation, to a dedicated processor (e.g., an embedded processor) for performing the corresponding operations, a generic-purpose processor (e.g., a CPU or an application processor), or the like, that can perform the operations by executing one or more software programs stored in a memory device.

Hereinafter, a washing machine according to an embodiment of the disclosure will be described with reference to the accompanying drawings.

Figure 1B:
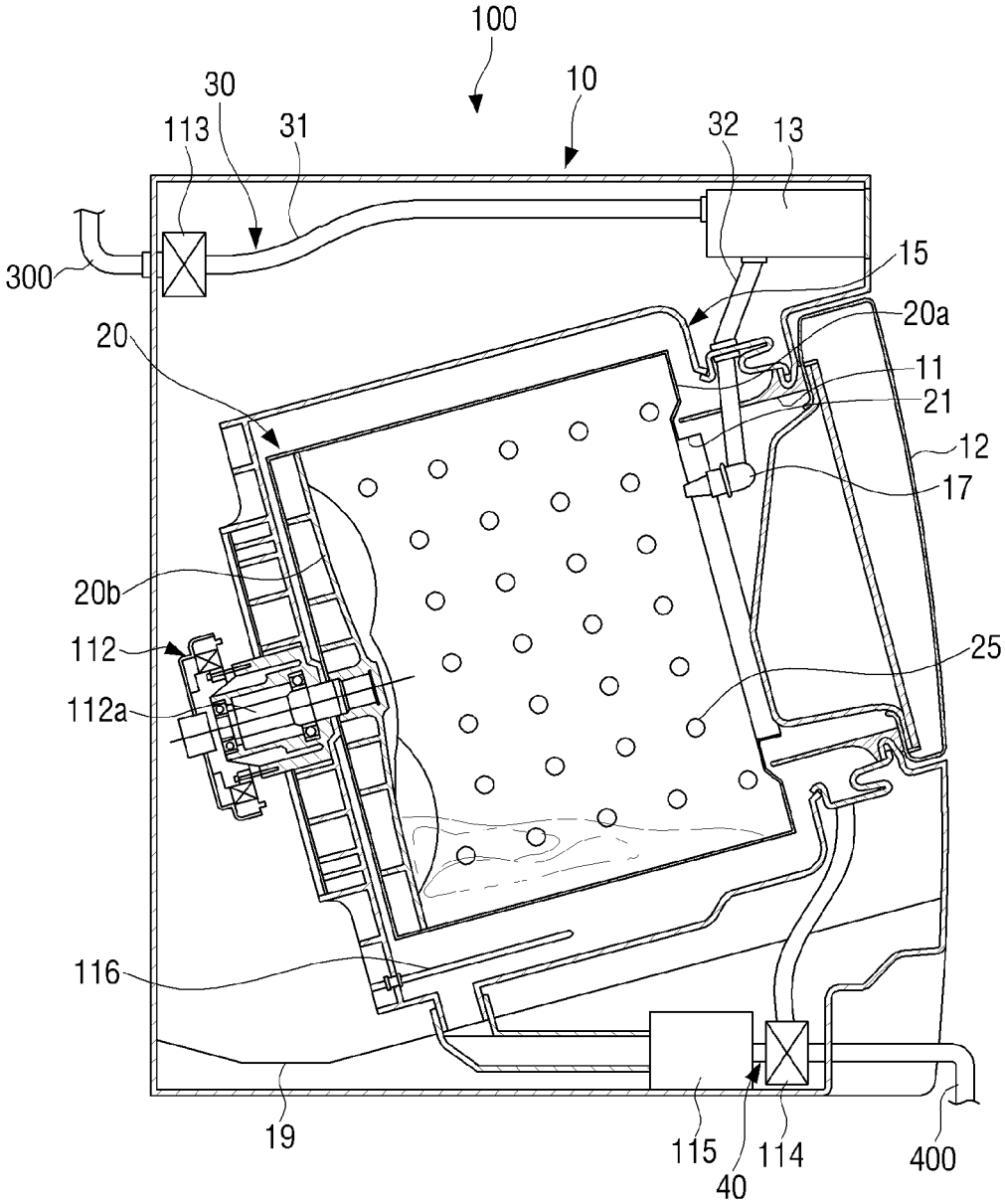
FIG. 1B illustrates a cross-sectional view of the washing machine according to an embodiment.

FIG. 1A illustrates a view for explaining a washing machine according to an embodiment of the disclosure and FIG. 1B illustrates a cross-sectional view of the washing machine for explaining a configuration of the washing machine according to an embodiment of the disclosure.

Referring to FIGS. 1A and 1B, a washing machine 100 according to an embodiment of the disclosure may include a cabinet 10, a tub 15, a spin basket 20, a water supply pipe 30, a drain pipe 40, and a driving unit 110.

The washing machine 100 may be implemented as a front load type for loading a laundry into the washing machine 100 from the front of the washing machine 100, a top load type for loading a laundry into the washing machine 100 from the top of the washing machine 100, and a hybrid type obtained by combining these. In addition, the washing machine 100 may be implemented as a pulsator type for rotating a pulsator formed on one surface (e.g., bottom surface) of the spin basket around a horizontal axis or a vertical axis to generate a water flow, an agitator type for rotating a wash rod formed along one shaft in the center of the tub, a drum type for rotating the spin basket around a horizontal axis to drop the laundry in the drum, a steam type for spraying steam at a high temperature, an air wash type for spraying air at a high temperature to remove dust, or a type obtained by combining these. The washing machine 100 illustrated in FIGS. 1A and 1B is illustrated as a front load type, but this is merely an embodiment, and the washing machine 100 may be implemented as various types described above. Hereinafter, the description will be made by assuming that the washing machine 100 of the disclosure is a front load type, for convenience of description.

In addition, the washing machine 100 according to embodiments of the disclosure may be implemented as a type combined with another electronic device. For example, the washing machine may include at least one of a dryer, a personal computer (PC), a television (TV), a digital video disk (DVD) player, an audio system, a refrigerator, air-conditioner, an oven, a vacuum cleaner, a set top box, a home automation control panel, a security control panel, a media box (e.g., SAMSUNG HOMESYNC™, APPLE TV™, or GOOGLE TV™), a game console (e.g., XBOX™, PlayStation™), an electronic frame, a security device, industrial or domestic robots, or Internet of Things device (e.g., light bulb, sensor, electric or gas meter, sprinkler device, fire alarm, thermostat, street light, heater, boiler, etc.).

The cabinet 10 may form appearance of the washing machine 100. The cabinet 10 may include a laundry opening 11 formed with an opening on a side from which a laundry is loaded (e.g., upper portion or front portion) so that the laundry is loaded thereto, a door 12 formed on one side of the laundry opening 11 to rotatably open and close the laundry opening 11, and a water storage 19 storing leaked wash water.

A tub 15 may be installed in the cabinet 10. For example, the tub 15 may be installed at a predetermined angle with respect to an installation plane of the washing machine 100 (e.g., horizontal plane) so that a front portion of the tub 15 is at a higher position than a rear portion of the tub 15 in the cabinet 10. The spin basket 20 may be installed in the tub 15 at the same angle as the tub 15. The front portion may refer to a surface where an opening formed in the same direction as the laundry opening 11 of the cabinet 10 exists so that the laundry is able to be loaded, and the rear portion may refer to a surface opposite to the front portion. However, this is merely an embodiment, and the tub 15 and the spin basket 20 may be installed not to tilt.

The rotatable spin basket 20 may be installed in the tub 15. Specifically, the tub 15 may be implemented in a shape with an empty inner portion so that the spin basket 20 is installed therein, and the tub 15 may be implemented in a cylindrical shape so that the spin basket 20 is rotatable. For this, a motor 112 and a rotation shaft 112*a* of the driving unit 110 for rotating the spin basket 20 may be installed on the rear portion of the tub 15. In this case, the tub 15 may further include a suspension device (not shown) for reducing vibration generated when rotating the spin basket 20.

A spraying nozzle 17 may be formed on one side of the upper portion of the tub 15 and the spraying nozzle 17 may be connected to the water supply pipe 30 to supply wash water into the spin basket 20. The drain pipe 40 for draining the wash water may be connected to one side of the lower portion of the tub 15. The spin basket 20 may be installed in the tub 15 and accommodate the wash water or the laundry. The wash water may refer to normal water, but the wash water may refer to a mixture further including a detergent, contaminants, and the like, in addition to water. Accordingly, the spin basket 20 may be implemented in a shape with an empty inner portion. Specifically, an opening 21 may be formed on a front portion 20*a* of the spin basket 20 in the same direction as the laundry opening 11 of the cabinet 10 so that the laundry is loaded thereto. For example, as illustrated in FIG. 1, the spin basket 20 may be installed so that the front portion 20*a* of the spin basket 20 is at a higher position than a rear portion 20*b* of the spin basket 20, that is, to have a predetermined angle (e.g., 5 degrees, 15 degrees, 30 degrees, or the like) with respect to the horizontal plane. However, this is merely an embodiment, and the front portion 20*a* and the rear portion 20*b* of the spin basket 20 may be installed to have an angle which does not tilt (0 degree). The spin basket 20 may be rotatably driven along one axis. For this, the spin basket 20 may be implemented in a cylindrical shape. In addition, the rear portion 20*b* of the spin basket 20 may be combined with a rotary shaft 112*a* of the driving unit 110 installed on the rear portion of the tub 15. In this case, the spin basket 20 may rotate along the shaft direction of the rotary shaft 112*a* by receiving power (e.g., torque) generated from the motor 112 of the driving unit 110 via the rotary shaft 112*a*.

In addition, a plurality of through holes 25 may be formed on a wall surface of the spin basket 20. Specifically, the plurality of through holes 25 arranged at regular interval may be formed on the wall surface of the spin basket 20, and the wash water in the spin basket 20 may be leaked through the plurality of through holes 25 to drain to an external drain pipe 400. For example, during a water supply process of the washing machine 100, the wash water supplied from an external water supply pipe 300 may be supplied into the tub 15 through the spraying nozzle 17 connected to the water supply pipe 30. The spin basket 20 may rotate at a high speed (e.g., 1,000 to 3,000 times of rotations per minute) during a dehydration process of the washing machine 100, the wash water in the spin basket 20 may leak outside of the spin basket through the plurality of through holes 25 due to a centrifugal force of the spin basket 20, and the wash water accommodated in a space between an external wall of the spin basket 20 and an inner wall of the tub 15 may drain to the external drain pipe 400 along the drain pipe 40.

The water supply pipe 30 may refer to a flow path which connects the external water supply pipe 300 and the tub 15 or the spin basket 20 to supply the wash water from the external water supply pipe 300 to the tub 15 or the spin basket 20. The water supply pipe 30 may be formed as a pair to supply cold water and hot water. In addition, the water supply pipe 30 may allow the wash water supplied from the external water supply pipe 300 to go through a detergent supply portion 13 to supply a detergent filled in the detergent supply portion 13 into the spin basket 20 together with the wash water. The drain pipe 40 may refer to a flow path which connects the tub 15 and the external drain pipe 400 to drain the wash water filled in the spin basket 20 to the external drain pipe 400.

The driving unit 110 may perform general operations of the washing machine 100. The driving unit 110 may rotate the spin basket 20 or a pulsator (not shown) and this will be described below in detail.

The washing machine 100 according to an embodiment of the disclosure may perform a smart management function for managing the washing machine 100. The smart management function may refer to self-diagnosis performed for the washing machine while cleaning the inside of the washing machine 100.

Specifically, the washing machine 100 may perform a cleaning course for cleaning the spin basket 20 of the washing machine 100, obtain diagnosis information regarding the washing machine 100 while the cleaning course is performed, and provide the obtained diagnosis information to a user.

The cleaning course may refer to a series of operations performed by supplying the wash water to the spin basket 20 in a state where the spin basket 20 of the washing machine 100 does not accommodate a laundry, rotating the spin basket 20 filled with the wash water using a motor of the washing machine 100, and then draining the wash water filled in the spin basket. The course may include a plurality of unit processes (e.g., water supply process, washing process, dehydration process, drainage process, and the like). The washing machine 100 may remove the detergent, contaminants, bacteria, or mold remaining in the spin basket 20 by performing the cleaning course, and accordingly, the spin basket 20 of the washing machine 100 may be maintained clean. In addition, the cleaning course may include an operation of rotating the spin basket 20 at a high speed after draining the wash water or while draining the wash water to dehydrate the spin basket 20.

The diagnosis information regarding the washing machine 100 may be obtained while performing the cleaning course by the washing machine 100 and may include information regarding each element included in the washing machine 100 or information regarding whether the operation performed by each element is able to be normally performed.

In an embodiment, the diagnosis information regarding the washing machine 100 may include at least one piece of information from information indicating a weight of the spin basket 20, abnormality of a water supply valve 113 for supplying the wash water to the spin basket 20, a temperature of the wash water supplied to the spin basket 20, a flow rate of the wash water supplied to the spin basket 20, abnormality of the motor 112, abnormality of a drain valve 114 for draining the wash water, a flow rate of the wash water draining from the spin basket 20, and vibration of the washing machine 100. This will be described below in detail.

The user may refer to at least one of a user using the washing machine 100, a manager having authority to manage the washing machine 100, a company which manufactures, manages, and repairs the washing machine 100, and the like.

The washing machine 100 according to an embodiment of the disclosure may obtain diagnosis information for diagnosing whether the washing machine 100 normally performs each operation performed in the cleaning course, while performing the cleaning course for maintaining the inside of the washing machine 100 clean by removing a detergent, contaminants, bacteria, or mold remaining in the washing machine 100, and provide the obtained diagnosis information to the user.

Accordingly, the washing machine 100 of the disclosure may diagnose and manage by itself using energy (water, electric power, time, and the like) consumed in this process while maintaining the inside of the washing machine 100 clean by performing a smart management function, thereby improving energy efficiency.

In addition, the washing machine 100 of the disclosure may maintain/manage the washing machine in an optimal state by storing and using the diagnosis information, thereby reducing maintenance/management cost.

Further, the washing machine 100 of the disclosure may perform the self-diagnosis more correctly, from a viewpoint of performing the smart management function in a state where the laundry is absent in the spin basket of the washing machine 100.

Hereinafter, the washing machine according to an embodiment of the disclosure will be described in more detail with reference to the accompanying drawings.

Figure 2A:
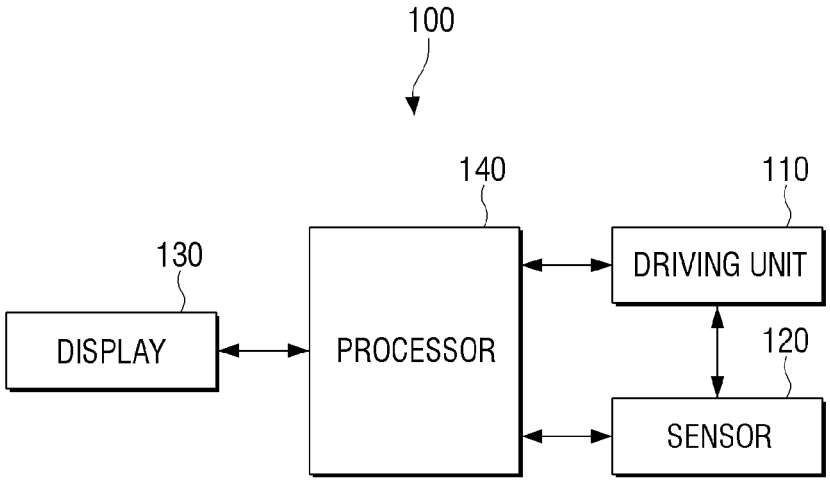
FIG. 2A is a block diagram illustrating a configuration of the washing machine according to an embodiment.
Figure 2B:
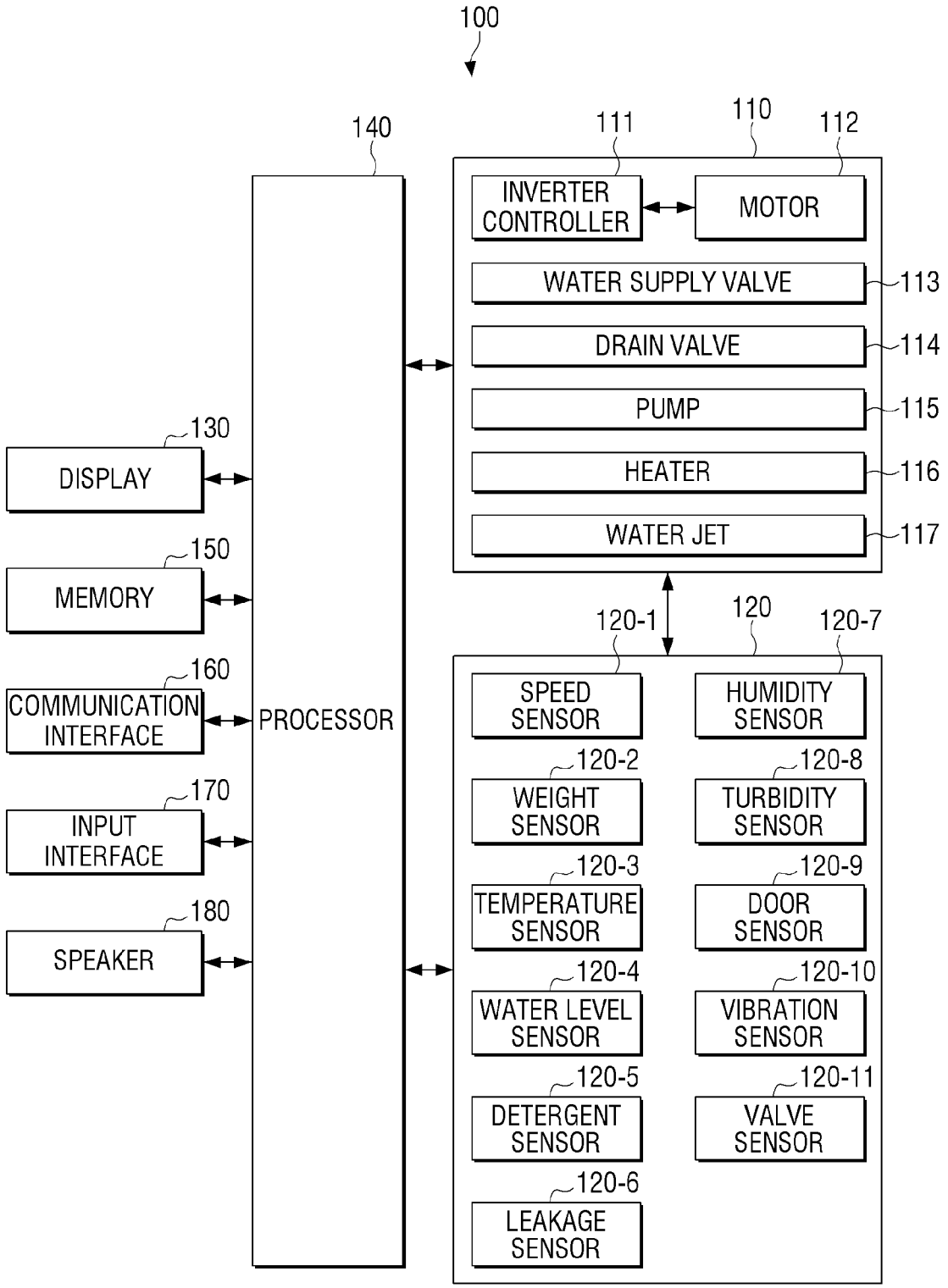
FIG. 2B is a block diagram specifically illustrating the configuration of the washing machine according to an embodiment.

FIG. 2A is a block diagram illustrating a configuration of the washing machine according to an embodiment of the disclosure, and FIG. 2B is a block diagram specifically illustrating the configuration of the washing machine according to an embodiment of the disclosure.

Referring to FIG. 2A, the washing machine 100 may include the driving unit 110, a sensor 120, a display 130, and a processor 140.

The driving unit (or driver) 110 may be an element for performing general mechanical operations of the washing machine 100 and may perform the operation under the control of the processor 140. The driving unit 110 may rotate the spin basket 20 of the washing machine 100. For this, the driving unit 110 may include an inverter controller 111 and the motor 112, as illustrated in FIG. 2B.

The inverter controller 111 may refer to a device capable of driving the motor 112 by controlling a speed and a torque of the motor 112. The inverter controller may control the speed of the motor 112 according to a control signal of the processor 140 and the inverter controller 111 may control the speed of the motor 112 using a voltage control method or a frequency conversion method.

The motor 112 may rotate the spin basket 20. Here, the motor 112 may refer to a motor which convers an energy (e.g., electric power or the like) applied from the outside into power energy. For this, the motor 112 may include a stator (not shown) and a rotor (not shown). The stator may include a plurality of wound coils and internal resistance. The rotor may include a plurality of magnets causing electric interaction with the coils. The rotor may rotate by the electric interaction between the coils and the magnets.

The motor 112 may transfer the converted power energy to the rotation shaft 112*a*. Here, the rotation shaft 112*a* may be combined with the motor 112 and the spin basket 20 to transfer the power transferred from the motor 112 to the spin basket 20, thereby rotating the spin basket 20. For this, the rotation shaft 112*a* may include a shaft, a bearing ring, and the like. However, this is merely an embodiment, and the structures of the motor 112, the rotation shaft 112*a*, and the spin basket 20 may vary depending on the structure of the washing machine 100.

In an embodiment, assuming that the washing machine 100 is a drum type, the motor 112 may transfer the power to the spin basket 20 through the rotation shaft 112*a*. The rotation shaft 112*a* may be combined with a rear portion 20*b* of the spin basket 20 and transfer the power according to the driving of the motor 112 to the spin basket 20 to rotate the spin basket 20. In another embodiment, if the washing machine 100 is a pulsator type, the spin basket 20 may include a pulsator (not shown) installed on a bottom surface therein and combined with the rotation shaft 112*a*, and the motor 112 may transfer the power to the pulsator through the rotation shaft 112*a* to rotate the pulsator.

The driving unit 110 according to an embodiment of the disclosure may rotate the spin basket 20 and also rotate the spin basket 20 and the pulsator at the same time. For this, the driving unit 110 may further include, for example, a clutch (not shown) for transferring the power according to the driving of the motor 112 to at least one of the spin basket 20 and the pulsator. In this case, the motor 112 may be mechanically connected to the clutch via a belt (not shown) to transfer the power to the clutch and the clutch may be combined with the rotation shaft 112*a*. For example, the clutch may transfer the power to all or some of a first rotation shaft combined with the spin basket 20 and a second rotation shaft combined with the pulsator which are included in the rotation shaft 112*a*.

The motor 112 may further include a hall sensor (not shown). For example, the hall sensor may be installed at intervals of specific positions or specific angles of the motor 112, and the hall sensor may output positional information of a rotor according to the rotation of the rotor as an on or off signal and detect a rotation direction, a rotation speed ($\omega$), and a rotation angle ($\theta$) based on the signal of the rotor.

Referring to FIG. 2B, the driving unit 110 according to an embodiment of the disclosure may further include at least one of the water supply valve 113, the drain valve 114, the pump 115, the heater 116, and the water jet 117.

The water supply valve 113 may be opened or closed under the control of the processor 140 so that the wash water is supplied into the spin basket 20 or blocked. For this, the water supply valve 113 may be implemented as a solenoid valve, an electromagnet valve, and the like which may be opened or closed according to movement of the coils according to applied current.

For example, the water supply valve 113 may be installed between the external water supply pipe 300 and the water supply pipe 30 of the washing machine 100. The water supply pipe 30 of the washing machine 100 may connect the external water supply pipe 300 and the spin basket 20, and if the water supply valve 113 is turned on, the wash water may be supplied into the spin basket 20 along the water supply pipe 30. In other words, the water supply valve 113 may control the wash water to be supplied into the spin basket 20 or blocked from the external water supply pipe 300 according to the state (on or off state) of the water supply valve 113.

The water supply pipe 30 may include a first water supply pipe 31 connecting the external water supply pipe 300 to the detergent supply portion 13 and a second water supply pipe 32 connecting the detergent supply portion 13 to the spin basket 20, and the wash water supplied from the external water supply pipe 300 may go through the detergent supply portion 13 to supply a detergent filled in the detergent supply portion 13 into the spin basket 20 together with the wash water.

The external water supply pipe 300 may include a hot water supply pipe and a cold water supply pipe respectively providing wash water distinguished as hot water and cold water according to the temperature. In this case, the water supply valve 113 may independently (individually) control each of the hot water supply pipe and the cold water supply pipe so that the wash water is supplied into the spin basket 20 or blocked according to the state (on or off state) of the water supply valve 113. As described above, the water supply valve 113 may adjust an amount or a ratio of hot water and cold water supplied into the spin basket 20 and adjust a temperature of the wash water filled in the spin basket 20.

The drain valve 114 may be opened or closed under the control of the processor 140 so that the wash water filled in the spin basket 20 is drained or remains. For this, the drain valve 114 may be implemented as a solenoid valve, an electromagnet valve, and the like which may be opened or closed according to movement of the coils according to applied current.

For example, the drain valve 114 may be installed between the drain pipe 40 of the washing machine 100 and the external drain pipe 400. The drain pipe 40 of the washing machine 100 may connect the spin basket 20 to the external drain pipe 400, and if the drain valve 114 is turned on, the wash water filled in the spin basket 20 may drain to the external drain pipe 400 along the drain pipe 40. In other words, the drain valve 114 may control the wash water to be drained to the external drain pipe 400 from the spin basket 20 or remain therein according to the state (on or off state) of the drain valve 114.

The pump 115 may discharge the wash water filled in the spin basket 20 to the external drain pipe 400 using power or pressure under the control of the processor 140. For this, the pump 115 may be installed to connect to the drain pipe 40. In addition, the pump 115 may include a shaft (not shown) including an impeller (not shown), an electric motor (not shown) mechanically connected to the shaft, a suction pipe (not shown) connected to the drain pipe 40, and a discharge pipe connected to the external drain pipe 400. If the drain valve 114 is turned on and the impeller rotates by the electric motor of the pump 115, the wash water in the spin basket 20 may be forcibly discharged to the external drain pipe 400 through the suction pipe and the discharge pipe.

The heater 116 is an element which, if the power is applied, converts the applied electric energy into thermal energy and transfer the thermal energy to the spin basket 20 under the control of the processor 140. For this, the heater 116 may be installed in the tub 15. For example, the heater 116 may heat the wash water filled in the spin basket 20 to boil the wash water for the laundry or clean the spin basket 20. In addition, the heater 116 may heat the spin basket 20 to dry the laundry in the spin basket 20.

The water jet 117 may include a water jet pump (not shown) and a nozzle (not shown) and may spray the flowed wash water at high pressure using the water jet pump via the nozzle and spray the wash water to a specific position in the spin basket 20 to remove contaminants remaining in the spin basket 20. In this case, the water jet 117 may be implemented as a device separate from the spraying nozzle 17 for supplying the wash water into the spin basket 20 or the water jet 117 may also be implemented as one device integrally formed with the spraying nozzle 17.

The sensor 120 may detect an operation state or a surrounding environment of the washing machine 100 or generate and output an electric signal regarding a detection result. The sensor 120 may transfer an electric signal to the processor 140 or store the detection result in the memory 150 of the washing machine 100 or an external device.

Specifically, the sensor 120 may detect the operation state or the surrounding environment of the washing machine 100 and obtain diagnosis information regarding the washing machine 100, while performing the cleaning course. In this case, the sensor 120 may only detect the operation state or the surrounding environment of the washing machine 100 for obtaining the diagnosis information to generate an electric signal or obtain data as the detection result, and the processor 140 may process the signal or data received from the sensor 120 to obtain the diagnosis information.

The diagnosis information may include at least one piece of information indicating a weight of the spin basket 20, abnormality of the water supply valve 113 for supplying the wash water to the spin basket 20, a temperature of the wash water supplied to the spin basket 20, a flow rate of the wash water supplied to the spin basket 20, abnormality of the motor 112, abnormality of the drain valve 114 for draining the wash water, a flow rate of the wash water draining from the spin basket 20, and vibration of the washing machine 100.

For this, the sensor 120 may include at least one of a speed sensor 120-1, a weight sensor 120-2, a temperature sensor 120-3, a water level sensor 120-4, a detergent sensor 120-5, a leakage sensor 120-6, a humidity sensor 120-7, a turbidity sensor 120-8, a door sensor 120-9, a vibration sensor 120-10, and a valve sensor 120-11. The sensors included in the sensor 120 may be implemented as separate devices which are physically separated or the sensors may also be implemented as one device. In other words, the sensor 120 may not be limited to one physical device.

The speed sensor 120-1 may detect a rotation speed (ω), a rotation angle (θ), a rotation direction, and the like of the motor 112 or the spin basket 20. In this case, the processor 140 may store the rotation speed (ω), the rotation angle (θ), the rotation direction, and the like of the motor 112 or the spin basket 20 detected by the speed sensor 120-1 in the memory 150 as the diagnosis information, or may transmit these to an external device (e.g., server or smartphone) via the communication interface 160 and store these in the external device. For this, the speed sensor 120-1 may be implemented as a sensor using a method of detecting a magnitude of a load applied to the motor 112, when the motor 112 rotates the spin basket 20, a method of detecting an on/off signal of the hall sensor adjacent to a position of the rotor while the rotor of the motor 112 rotates, or a method of measuring a magnitude of a current applied to the driving unit 110 or the motor 112 during the rotation of the spin basket 20. However, this is merely an embodiment, and the sensors may be implemented in various types without limits.

The weight sensor 120-2 may detect a weight of the spin basket 20. In this case, the processor 140 may store the weight of the spin basket 20 detected by the weight sensor 120-2 in the memory 150 as the diagnosis information or may transmit this to an external device (e.g., server or smartphone) via the communication interface 160 and store this in the external device. In addition, the weight sensor 120-2 may detect a weight of a laundry. For example, if the laundry is present in the spin basket 20, the weight sensor 120-2 may detect the weight of the laundry and the spin basket 20 and measure a difference between the detected weight and the weight of the spin basket 20 stored in advance as the weight of the laundry.

In an embodiment, the weight sensor 120-2 may detect the weight of the spin basket 20 by rotating the spin basket 20 not accommodating the laundry and obtain the weight thereof as the diagnosis information. For this, the weight sensor 120-2 may detect the weight of the spin basket 20 by using a method for predicting a moment of inertia from the rotation speed (ω) and the rotation angle (θ) of the motor 112 or the spin basket 20 detected by the speed sensor 120-1 and predicting a weight corresponding to the moment of inertia.

In another embodiment, the weight sensor 120-2 may be implemented as various sensors which have a load cell deformed when the weight of the spin basket 20 is applied to the load cell, and detects a magnitude of a voltage according to the deformed shape thereof to predict the weight of the spin basket 20 corresponding to the magnitude of the voltage.

The temperature sensor 120-3 may detect a temperature of the surrounding environment (e.g., room temperature) of the washing machine 100 or detect a water temperature of the wash water. In this case, the processor 140 may store the temperature of the surrounding environment of the washing machine 100 or the water temperature of the wash water detected by the temperature sensor 120-3 in the memory 150 as the diagnosis information or may transmit this to an external device (e.g., server or smartphone) via the communication interface 160 and store this in the external device. For this, the temperature sensor 120-3 may be implemented, for example, as a thermistor which is a type of a resistor using a property of a resistance of a substance changing in accordance with a temperature, and the thermistor may have characteristics of a negative temperature coefficient (NTC) in which if the temperature increases, the resistance decreases, and if the temperature decreases, the resistance increases.

The temperature sensor 120-3 may further include a temperature adjustment device (e.g., thermostat) and the temperature adjustment device may detect a heating value generated from the heater 116 and control the temperature of the wash water or the spin basket 20 to be maintained at a specific temperature by the heat generated from the heater 116.

The water level sensor 120-4 may detect a water level or a flow rate of the wash water. In this case, the processor 140 may store the water level or the flow rate of the wash water detected by the water level sensor 120-4 in the memory 150 as the diagnosis information or may transmit this to an external device (e.g., server or smartphone) via the communication interface 160 and store this in the external device. Specifically, the water level sensor 120-4 may detect the water level or the flow rate of the wash water while the wash water is supplied into the spin basket 20 or the wash water drains from the inside of the spin basket 20. For this, the water level sensor 120-4 may be implemented as a mechanical water level detection sensor, a pressure-sensitive sensor, a sensor using a semiconductor or capacitance, or the like.

Accordingly, the water level sensor 120-4 may obtain a flow rate of the wash water supplied to the spin basket 20 or a flow rate of the wash water draining from the spin basket 20 as the diagnosis information regarding the washing machine 100. The flow rate of the wash water supplied to the spin basket 20 may include a water supply rate and a water supply rate per time having a unit such as 1 min (litter/minute; LPM) or 1/s (litter/second; LPS) and the flow rate of the wash water draining from the spin basket 20 may include a drainage rate and a drainage rate per time.

In this case, the flow rate of the wash water supplied to the spin basket 20 and the flow rate of the wash water draining from the spin basket 20 may be used to determine water supply time and drainage time. For example, the amount (l) of the wash water to be supplied to the spin basket 20 may be divided by the water supply rate per time (l/min) to determine water supply time (min) of the wash water being supplied. In addition, a history regarding the flow rate of the wash water supplied to the spin basket 20 or the flow rate of the wash water draining from the spin basket 20 may be used to provide notification information to the user. For example, the history of the flow rate of the wash water supplied to the spin basket 20 or the flow rate of the wash water draining from the spin basket 20 may be compared with each other, and if the water supply rate per time (l/min) is decreased to be equal to or lower than a predetermined value (e.g., 2 l/min), notification information indicating that the water supply pipe 30 or the drain pipe 40 needs to be inspected or replaced may be generated to be provided to the user.

The detergent sensor 120-5 may detect a remaining amount or a type of the detergent (or rinsing agent). For example, the detergent sensor 120-5 may include a plurality of electrodes, may detect a remaining amount of a detergent or a type of a detergent through a resistance value between the plurality of electrodes, and may be installed in the detergent supply portion 13 which is partitioned into a plurality of spaces to input the detergent and the rinsing agent. In addition, the detergent sensor may be implemented as a water level sensor, a turbidity sensor, or a combination thereof.

The leakage sensor 120-6 may detect leakage of the wash water. In this case, the processor 140 may store the leakage of the wash water detected by the leakage sensor 120-6 in the memory 150 as the diagnosis information or may transmit this to an external device (e.g., server or smartphone) via the communication interface 160 and store this in the external device. For example, the wash water leaked from the tub 15 may be stored in the water storage 19 formed in the cabinet 10, and the leakage sensor 120-6 may detect a water level of the wash water filled in the water storage 19 and detect the leakage of the wash water, if the water level thereof is equal to or higher than a predetermined value. For this, the leakage sensor 120-6 may be implemented as a float switch.

The humidity sensor 120-7 may detect moisture (water vapor) in the air. For example, the humidity sensor 120-7 may be implemented as an electric resistance type or an electric capacitance type. Specifically, an electric resistance type humidity sensor may detect the humidity by detecting a change of an electric resistance of a substance having electric resistance changing when the substance absorbs moisture, and the electric capacitance type the humidity sensor may detect humidity by filling a dielectric substance having a dielectric constant changing according to the humidity between capacitors and detecting electric capacitance of both ends of the electrode.

The turbidity sensor 120-8 may detect a turbidity (degree of foreign materials included) of liquid. Specifically, the turbidity sensor 120-8 may detect a turbidity of the wash water used in the washing process, the rinsing process, and the like of the washing machine 100. For this, the turbidity sensor 120-8 may include a light emitting portion (not shown) and a light receiving portion (not shown). For example, the light emitting portion may emit light and the light receiving portion may receive this light. The turbidity may be detected from a difference between an amount of the light emitted by the light emitting portion and an amount of light received when this light is transmitted through the wash water and received by the water receiving portion. The turbidity may be used to determine washing time of a laundry, soak time of a laundry, the number of times of rinsing of a laundry, an amount of a detergent, and the like.

The door sensor 120-9 may detect opened or closed state of the door 12. For example, the door sensor 120-9 may detect the opened or closed state of the door 12 by detecting an intensity of a potential or a current, or an intensity of a magnetic field which varies depending on whether a part (e.g., a lever which is able to be combined with the cabinet 10) of the door 12 is in contact with the cabinet 10. For this, the door sensor 120-9 may be implemented as a reed switch or a checker switch.

The vibration sensor 120-10 may detect a degree of vibration of the washing machine 100. Specifically, the vibration sensor 120-10 may detect a degree of vibration of the washing machine 100 due to a rotation operation of the spin basket 20 while the spin basket 20 rotates in the cleaning or dehydration process. For this, the vibration sensor 120-10 may be implemented as micro electro mechanical systems (MEMS).

The valve sensor 120-11 may detect abnormality (or normality) of the operation of the water supply valve 113 or the drain valve 114. In this case, the processor 140 may store the abnormality of the operation of the water supply valve 113 or the drain valve 114 detected by the valve sensor 120-11 in the memory 150 as the diagnosis information or may transmit this to an external device (e.g., server or smartphone) via the communication interface 160 and store this in the external device. For example, the valve sensor 120-11 may detect a degree of opening (opening degree) of the water supply valve 113 or the drain valve 114 in a state where the water supply valve 113 or the drain valve 114 is turned on, and may detect that the operation of the water supply valve 113 or the drain valve 114 is abnormal, if the opening degree is lower than a predetermined value. In addition, the valve sensor 120-11 may detect a degree of opening (opening degree) of the water supply valve 113 or the drain valve 114 in a state where the water supply valve 113 or the drain valve 114 is turned off, and may detect that the operation of the water supply valve 113 or the drain valve 114 is abnormal, if the opening degree is equal to or higher than a predetermined value. In this case, the processor 140 may obtain the abnormality of the operation of the water supply valve 113 or the drain valve 114 through the valve sensor 120-11 as the diagnosis sensor and the processor 140 may generate notification information for notifying that the operation of the water supply valve 113 or the drain valve 114 is abnormal and provide this to the user. The valve sensor 120-11 may be implemented as various types of sensors in accordance with the structure of the water supply valve 113 or the drain valve 114.

The display 130 may display information. Specifically, the display 130 may display image data processed by an image processor (not shown) in a display area (or display). For example, the display 130 may display the diagnosis information obtained through the sensor 120 in the display area under the control of the processor 140. The display area may refer to at least a part of the display 130 exposed to one surface of a housing of the washing machine 100. A part of the display 130 may be combined with at least one of a front, side, upper, or rear area of the washing machine 100 in a form of a flexible display with a bendable or a display, a foldable display, or a rollable display. However, this is merely an embodiment, the display 130 may not be embedded in the washing machine 100 but may be implemented as an external display, and may display image data on an external display connected to the washing machine in a wired or wireless manner.

For this, the display 130 may be implemented as a type of a liquid crystal display (LCD), a light emitting display (LED), an organic light emitting display (OLED), a micro LED, an e-ink, and the like, but this is merely an embodiment, and the display 130 may be variously implemented without limitation.

The processor 140 may control the general operations of the washing machine 100. For this, the processor 140 may include a RAM (not shown), a ROM (not shown), a graphic processor (not shown), a main CPU (not shown), first to n-th interfaces (not shown), and a bus (not shown). The RAM (not shown), the ROM (not shown), the graphic processor (not shown), the main CPU (not shown), and the first to n-th interfaces (not shown) may be connected to each other via the bus (not shown).

When a user command for managing the washing machine 100 is received, the processor 140 may perform the cleaning course for cleaning the spin basket 20, obtain the diagnosis information regarding the washing machine 100 through the sensor 120, while the cleaning course is performed, and display the obtained diagnosis information on the display 130. The diagnosis information herein may be obtained by detecting the operation state or the surrounding environment of the washing machine 100 and may be used as information for maintaining/managing the washing machine 100.

In this case, the processor 140 may perform the cleaning course by controlling the driving unit 110 to supply the wash water to the spin basket 20 and rotate the spin basket 20 filled with the wash water. The cleaning course may include a series of operations performed to clean the inside of the spin basket 20 or the tub 15 by removing mold in the spin basket 20 or the tub 15. In addition, the cleaning course may refer to various names such as a tub cleaning course, a detergent-free tub cleaning course, and the like. This will be described below in detail with reference to FIGS. 3 to 4B.

Referring to FIG. 2B, the washing machine 100 according to an embodiment of the disclosure may further include one of the memory 150, the communication interface 160, an input interface 170, and a speaker 180, in addition to the driving unit 110, the sensor 120, the display 130, and the processor 140.

The memory 150 may store various instructions, programs, or data necessary for the operations of the washing machine 100 or the processor 140. For example, the memory 150 may store the information obtained by the sensor 120 and data received from an external electronic device (not shown).

The memory 150 may be implemented as a volatile memory such as a static random access memory (S-RAM) or a dynamic random access memory (D-RAM), a non-volatile memory such as a flash memory, a read only memory (ROM), an erasable programmable read only memory (EPROM), an electrically erasable programmable read only memory (EEPROM), a hard disk drive (HDD), or a solid state drive (SSD). The memory 150 may be accessed by the processor 140 and reading, recording, editing, deleting, or updating of the data by the processor 140 may be executed. In this disclosure, the term "memory" may include the memory 150, a RAM (not shown) or a ROM (not shown) in the processor 140, and a memory card (not shown) (e.g., micro SD card or memory stick) mounted on the washing machine 100.

The processor 140 and the memory 150 may be implemented as physically separated elements or may be implemented as a single element such that the processor 140 includes the memory 150. In addition, the processor 140 may be implemented as a single element or one system of a plurality of elements. The memory 150 may also be implemented as a single element or one system of a plurality of elements.

The communication interface 160 may transmit and receive various types of data by performing the communication with an external device (e.g., server or smartphone) according to various types of communication. For example, the communication interface 160 may transmit the information obtained by the sensor 120 to a server (or smartphone) or receive a control command for driving the washing machine 100 from the server (or smartphone). For this, the communication interface 160 may include at least one of a Bluetooth chip (not shown), a Wi-Fi chip (not shown), a wireless communication chip (not shown), and an NFC chip (not shown) for performing wireless communication, and an Ethernet module (not shown) and a USB module (not shown) for performing wired communication. In this case, the Ethernet module and the USB module performing the wired communication may perform communication with an external device via an input and output port (not shown).

The input and output port (not shown) may be implemented as a wired port such as a HDMI port, a display port, an RGB port, a digital visual interface (DVI) port, a Thunderbolt, a LAN port, a USB port, a lightning cable port, a component port, and the like. The input and output port may be used to transmit and receive various types of data by performing communication with various types of external devices through communication standards.

The input interface 170 may be an element which may receive various types of user commands from a user and may transmit the received user commands to the processor 140. For this, the input interface 170 may include, for example, a touch panel or keys. The touch panel may use, for example, at least one type of an electrostatic type, a pressure-sensitive type, an infrared type, or an ultrasonic type, and may include a control circuit for this. The touch panel may further include a tactile layer and provide a user a tactile reaction. The keys may be implemented as, for example, a physical button type, an optical type, or a virtual keypad type combined with a touch panel. The input interface 170 may receive a user command via an external device (not shown) such as a keyboard, a mouse, or a smartphone connected in a wired or wireless manner.

The input interface 170 may directly receive a user's voice via a microphone embedded in the washing machine 100 or an external microphone and may obtain an audio signal by converting the user's voice which is an analogue signal into a digital signal by a digital converter (not shown). In addition, according to an embodiment, the input interface 170 may receive a user's voice which is an analogue signal or an audio signal obtained by converting the user's voice into a digital signal from an external device (not shown) such as a smartphone or the like connected in a wired or wireless manner. In this case, the input interface 170 or the processor 140 may convert a user's voice into text data such as speech-to-text (STT) using various speech recognition algorithms, interpret the text data, recognize the meaning thereof, and perform a command according to the recognized meaning.

In a case of performing the wired communication, the input interface 170 may perform communication with an external device via the input and output port (not shown) described above.

The speaker 180 is embedded in the washing machine 100 and may output not only various pieces of audio data obtained by executing various processing such as decoding, amplification, or noise filtering by an audio processor (not shown), but also various alerts or voice messages directly as sounds.

Hereinafter, in relation to the operations of the processor 140, the cleaning course will be described first with reference to FIG. 3, and then, the diagnosis information obtained while performing the cleaning course and a method for obtaining this will be described with reference to FIGS. 4A and 4B.

Figure 3:
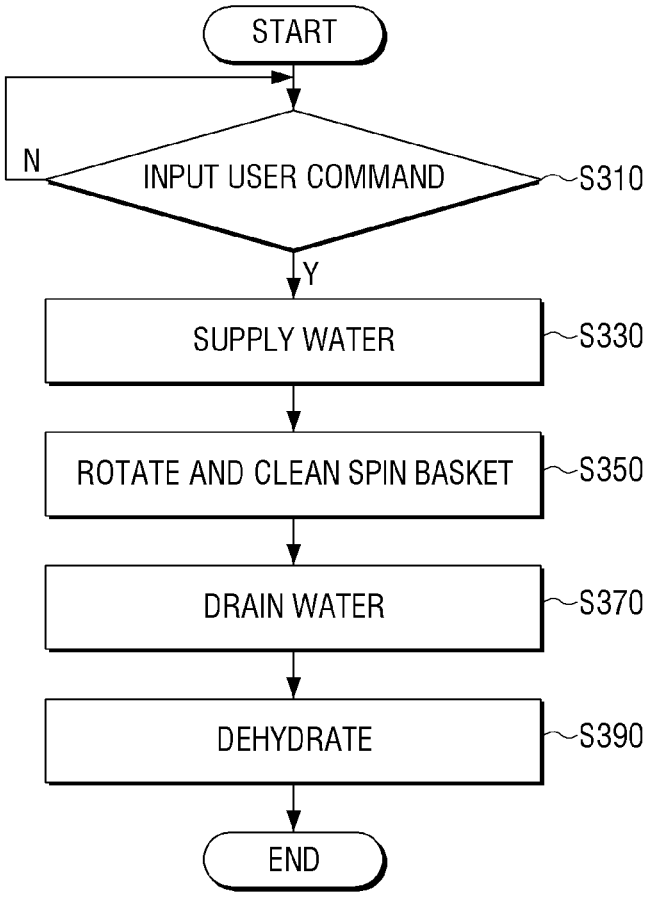
FIG. 3 illustrates a view for explaining a cleaning course according to an embodiment.

Referring to FIG. 3, the processor 140 may receive a user command for managing the washing machine 100 (S310).

The user command may be implemented in various forms such as a user's voice, a motion, a touch input, eye tracking, hovering, a button input, and the like. However, this is merely an embodiment, and the user command may be implemented in any forms in which the user may interact with the washing machine 100.

Specifically, the processor 140 may receive a user command for managing the washing machine 100 from an external device (not shown) via the communication interface 160 or receive a user command for managing the washing machine 100 via the input interface 170. For this, the washing machine 100 may further include the communication interface 160 or the input interface 170 and this has been described above in detail with reference to FIG. 2B.

When the user command for managing the washing machine 100 is received (S310, Y), the processor 140 may supply the wash water to the spin basket 20 as a water supply process (S330).

Specifically, the processor 140 may perform control of changing the water supply valve 113 in the off state to be turned on so that the water supply valve 113 is opened, thereby supplying the wash water to the spin basket 20.

In such a case, the processor 140 may adjust a period of time for maintaining the on state of the water supply valve 113 to adjust the amount of the wash water supplied to the spin basket 20. The amount of the wash water supplied in the cleaning course may be determined based on a capacity of the spin basket 20. For example, the amount of the wash water supplied in the cleaning course may be determined as a maximum amount which may be accommodated in the spin basket 20 or an amount of a predetermined ratio.

In addition, the processor 140 may adjust a period of time for maintaining the on state of the water supply valve 113 with respect to cold water or hot water to adjust a temperature of the wash water supplied to the spin basket 20. In this case, the processor 140 may drive the heater 116 to adjust the temperature of the wash water. For example, when the spin basket 20 is filled with the wash water obtained by mixing cold water and hot water, the processor 140 may detect the temperature of the filled wash water using the sensor 120, and control the heater 116 to be operated until the temperature of the wash water becomes a predetermined temperature, if the temperature of the wash water is lower than the predetermined temperature (e.g., 70 degrees).

Hereinafter, if the predetermined amount of the wash water is supplied to the spin basket 20, the processor 140 may perform control of changing the water supply valve 113 in the on state to the off state so that the water supply valve 113 is closed, thereby stopping the supply of the wash water.

When the supply of the wash water is stopped and the water supply process is completed, the processor 140 may control the driving unit 110 to rotate the spin basket 20 filled with the wash water as the cleaning process (S350). Specifically, the processor 140 may apply a control signal for rotating the spin basket 20 filled with the wash water to the motor 112 of the driving unit 110, and the motor 112 may transfer a torque according to the applied control signal to the spin basket 20 to rotate the spin basket 20. The control signal may refer to a signal for driving the motor 112 in stepwise manner. For example, the control signal may be a signal for driving the motor 112 at a rotation speed which is reduced, increased, or maintained over time. In addition, the processor 140 may control the water jet 117 to spray the wash water at a high temperature or under high pressure to remove contaminants attached to the inside of the spin basket 20. The processor 140 may also control the driving unit 110 to rotate the pulsator of the washing machine 100.

When the cleaning process is completed, the processor 140 may drain the wash water filled in the spin basket 20 as a drainage process (S370). Specifically, the processor 140 may perform control of changing the drain valve 114 in the off state to the on state so that the drain valve 114 is opened, thereby draining the wash water filled in the spin basket 20 outside. In addition, the processor 140 may control the pump 115 to discharge the wash water filled in the spin basket 20 to the external drain pipe 400 using power or pressure.

The processor 140 may control the driving unit 110 to rotate the spin basket 20 as a dehydration process (S390). Specifically, the processor 140 may apply the control signal for rotating the spin basket 20 to the motor 112 of the driving unit 110. At this time, the motor 112 may transfer the torque according to the applied control signal to the spin basket 20 to rotate the spin basket 20. The control signal may refer to a signal for driving the motor 112 in stepwise manner. For example, the control signal may be a signal for driving the motor 112 at a rotation speed which is reduced, increased, or maintained over time. The above embodiment has been described that the drainage process and the dehydration process are separately performed, but this is merely an embodiment, and the drainage process and the dehydration process may be performed at the same time or the drainage process may be performed after the dehydration process.

According to an embodiment of the disclosure, the processor 140 may perform control of repeatedly performing a set of processes in the order of {the water supply process S330, the cleaning process S350, and the drainage process S370} n times and then perform the dehydration process S390 finally. In this case, the operations included in the set may be changed within a range of the above description or an equivalent range.

Figure 4A:
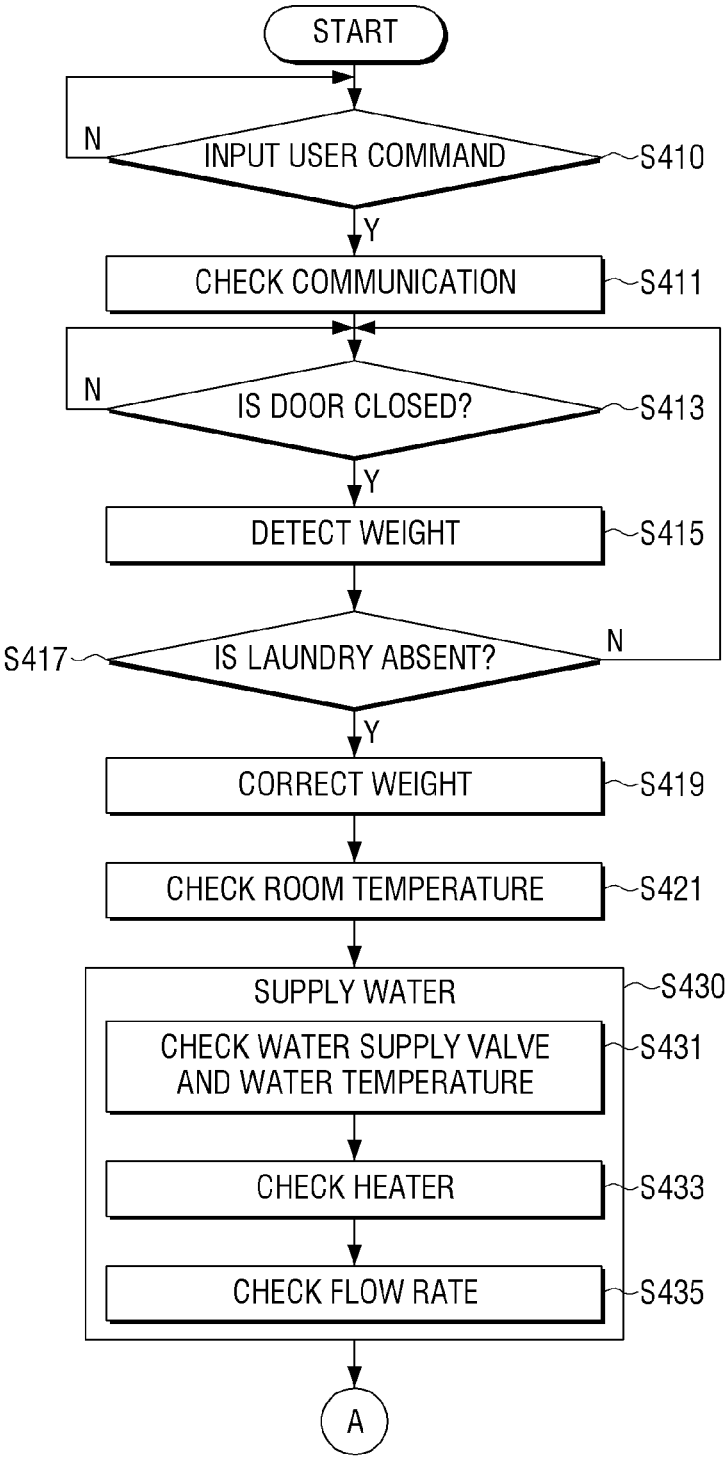
FIG. 4A illustrates a view for explaining a method for obtaining diagnosis information according to an embodiment.
Figure 4B:
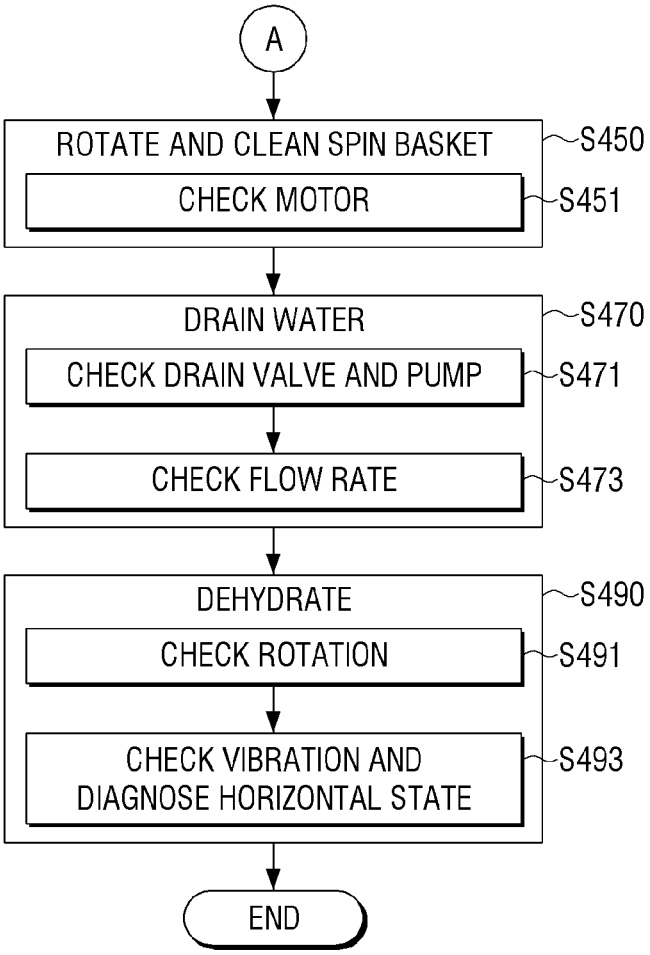
FIG. 4B illustrates a view for explaining a method for obtaining diagnosis information according to an embodiment.

Referring to FIGS. 4A and 4B, the processor 140 may receive a user command for managing the washing machine 100 (S410). The part overlapped with Step S310 will not be repeated.

When the user command for managing the washing machine 100 is received (S410, Y), the processor 140 may check communication of the washing machine 100 from information regarding the washing machine 100 (S411). The information regarding the washing machine 100 may include model information of the washing machine 100, capacity of the spin basket 20, information of hardware of the washing machine 100 (memory 150, communication interface 160, input interface 170, speaker 180, and the like), and the like. In this case, the information regarding the washing machine 100 may be stored in the memory 150 of the washing machine 100 in advance.

For example, the processor 140 may access the information regarding the washing machine 100 stored in advance, check whether the washing machine 100 includes the communication interface 160 capable of performing communication through Wi-Fi, Wi-Fi direct, Bluetooth, or the like, and if the communication interface 160 is included, the processor 140 may check whether the data is able to be normally transmitted or received by performing the communication with an external device via the communication interface 160. In this case, the processor 140 may obtain information regarding whether the communication interface 160 is normally operated as the diagnosis information.

When the communication check is completed (S411), the processor 140 may check whether the door 12 is closed using the sensor 120 (S413). For example, the processor 140 may obtain information regarding the opened or closed state of the door 12 by receiving a signal regarding the opened or closed state of the door 12 detected by the door sensor 120-9 included in the sensor 120.

If the door is opened (S413, N), the processor 140 may provide notification information for notifying that the door is opened to the user. For example, the processor 140 may control the display 130 to display a text or a symbol for notifying that the door is opened, and if the washing machine 100 includes the speaker 180, the processor 140 may control the speaker 180 to output a sound such as a beep sound or a voice for notifying that the door is opened. In addition, if the washing machine 100 includes the communication interface 160, the processor 140 may control the communication interface 160 to transmit information for notifying that the door is opened to an external device (e.g., server of a manufacturer, a cloud server, or a smartphone of a user).

Hereinafter, the description will be made by assuming that the door is closed (S413, Y).

The processor 140 may detect a weight of the spin basket 20 using the sensor 120 (S415) before supplying the wash water to the spin basket 20, and obtain the detected weight as the diagnosis information, if it is determined that the laundry is absent in the spin basket 20 based on the detected weight (S417, Y). The detected weight may be used to detect a weight of the laundry when washing the laundry. For example, when the washing machine 100 performs the washing course for washing the laundry, the processor 140 may detect the weight of the laundry loaded into the spin basket 20 and the spin basket 20 using the weight sensor 120-2 included in the sensor 120, and detect the weight of the laundry using a difference between the weight of the laundry and the spin basket 20 detected using the weight sensor 120-2 and the weight of the spin basket 20 of the diagnosis information.

Specifically, the processor 140 may detect the weight of the spin basket 20 using the weight sensor 120-2 (S415) and determine whether the laundry is present in the spin basket 20 based on the detected weight (S417). For example, the processor 140 may control the driving unit 110 to rotate the spin basket 20, predict a moment of inertia from a rotation speed ($\omega$) and a rotation angle ($\theta$) detected using the weight sensor 120-2, and detect the weight corresponding to the moment of inertia.

In this case, the processor 140 may determine that the laundry is present in the spin basket 20, if a difference (e.g., 5 kg) between the weight of the spin basket 20 stored in the washing machine 100 in advance (e.g., 30 kg) and the weight of the spin basket 20 detected using the weight sensor 120-2 (e.g., 35 kg) exceeds a predetermined value (e.g., 3 kg), and may determine that the laundry is absent in the spin basket 20, if the a difference (e.g., 1 kg) between the weight of the spin basket 20 stored in the washing machine 100 in advance (e.g., 30 kg) and the weight of the spin basket 20 detected using the weight sensor 120-2 (e.g., 31 kg) is less than a predetermined value (e.g., 3 kg).

If the laundry is present in the spin basket 20 (S417, N), the processor 140 may provide notification information for notifying that the laundry is present in the spin basket 20 to the user. The description regarding the method for providing the notification information described in Step S413 (Y) may be applied in the same manner, and therefore the specific description thereof will not be repeated.

If the laundry is absent in the spin basket 20 (S417, Y), the processor 140 may perform weight correction regarding the spin basket 20 (S419). In other words, if the laundry is absent in the spin basket 20, the processor 140 may perform calibration (or called Self-Calibration) for weight of the spin basket 20.

Specifically, the processor 140 may correct and update the weight of the spin basket 20 stored in the washing machine 100 in advance to the weight of the spin basket 20 of the obtained diagnosis information. For example, the processor 140 may correct and update the weight thereof to the weight of the spin basket 20 of the most recently obtained diagnosis information from a plurality of pieces of diagnosis information.

Accordingly, the processor 140 may transmit a control signal for rotating the spin basket 20 at a specific rotation rate (e.g., RPM) as a reference input signal to the motor 112 based on the corrected weight of the spin basket 20. The offset of the control signal may be changed based on the corrected weight of the spin basket 20.

Hereinafter, a result of weight correction according to an embodiment of the disclosure will be described in detail with reference to FIG. 5. In this case, it is assumed that the weight of the laundry is determined based on data obtained using a weight detection value of the empty spin basket.

Figure 5:
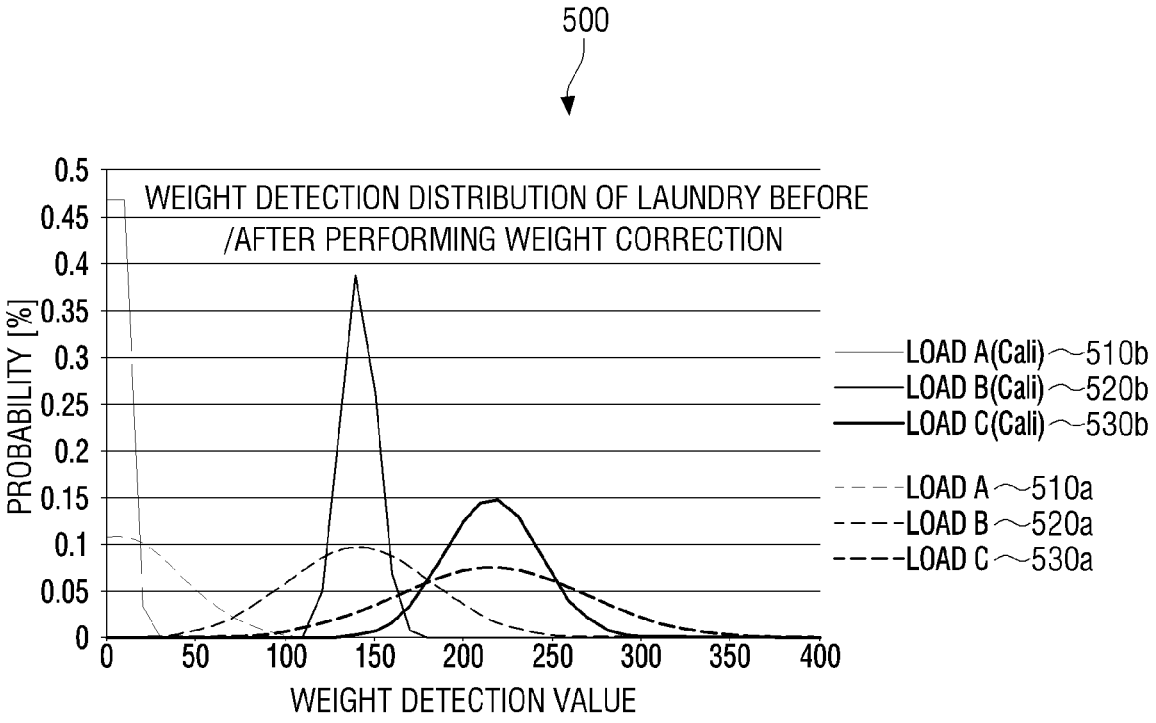
FIG. 5 illustrates a view for explaining a result obtained by correcting a weight according to an embodiment.

Referring to FIG. 5, a graph of FIG. 5 illustrates experiment data regarding results of detection of weights of laundries of a plurality of washing machines. Specifically, the graph of FIG. 5 illustrates results obtained by detecting weights of spin baskets in a state where laundries having different weights (becoming heavier in the order of load A, load B, and load C) are loaded in the spin baskets of a plurality of washing machines, respectively. Herein, an x axis indicates a value of detected weight and a y axis indicates a number (probability) of washing machines having the corresponding weight detection value.

The spin basket included in each of the plurality of washing machines may have distribution regarding the weight. However, since the value set as the weight of the spin basket is normally not a value obtained by precisely measuring the weight of the spin basket, but is an average value of the spin baskets included in the plurality of washing machines, the plurality of washing machines may detect the weights of the spin baskets in a state where the laundries with the load A (510*a*), the load B (520*a*), and the load C (530*a*) are loaded, as dotted lines in the graph of FIG. 5. In this case, if the weight detection value is in an area of the overlapped dotted lines (e.g., 40 to 260), some washing machines of the plurality of washing machines may not distinguish which load among loads A (low load), B (middle load), and C (high load) is the load of the laundry. Accordingly, the washing machine may waste energy more than necessary by erroneously recognizing the amount of the laundry.

The plurality of washing machines according to an embodiment of the disclosure which have performed the weight correction may detect the weights of the spin basket in states where the laundries with a load A (510*b*), a load B (520*b*), and a load C (530*b*) are loaded, as solid lines in the graph of FIG. 5. In this case, it is possible to improve resolution regarding the weight detection of the laundry, since the area of the overlapped solid lines (e.g., 140 to 170) is reduced than the area of the overlapped dotted lines (e.g., 40 to 260) which are results before the weight correction.

If the weight correction is completed, the processor 140 may obtain room temperature (or external temperature) information as diagnosis information by detecting the temperature around the washing machine 100 using the temperature sensor 120-3 included in the sensor 120 (S421).

The room temperature information may be used to check whether it is a temperature at which the operations of the washing machine 100 (e.g., operation of washing the laundry and the like) are able to be normally performed. For example, it is possible to check whether the temperature around the washing machine 100 is within a range of normal operation temperatures (e.g., −10 degrees to 50 degrees) of the washing machine 100 or whether the washing machine 100 is frozen using the room temperature information. In addition, the room temperature information may be used to provide an additional function of recommending natural drying or usage of a drier to a user, when the washing machine 100 completes the operation of washing the laundry.

In the above description, the processor 140 has performed the operations in the order of Steps S411, S413, S415, S417, S419, and S421, but this is merely an embodiment, and these operations may be performed in a different order or at the same time. In an embodiment, in Step S411 of checking the communication, the processor 140 may also obtain the information regarding the room temperature using the temperature sensor 120-3, and these operations may be performed by various changing the order or time. However, the step of obtaining the information regarding the room temperature is preferably performed in a state where the wash water is not supplied or flowed to ensure accuracy of the temperature, since the supplied wash water may change the surrounding temperature.

Next, the processor 140 may supply the wash water to the spin basket 20 as the water supply process (S430). The description overlapped with Step S330 will not be repeated.

In this case, the processor 140 may obtain information regarding whether the water supply valve 113 is normally operated using the valve sensor 120-11 included in the sensor 120, and if the water supply valve 113 is normally operated, the processor 140 may supply the wash water to the spin basket 20 by turning on the water supply valve 113 in the off state, and obtain information regarding a temperature of the wash water using the temperature sensor 120-3 while the wash water is supplied to the spin basket 20 (S431).

Specifically, the processor 140 may obtain information regarding whether the water supply valve 113 is normally operated as the diagnosis information, according to a signal detected by a circuit included in the water supply valve 113 using the valve sensor 120-11. If the water supply valve 113 is normally operated, the processor 140 may supply the wash water to the spin basket 20 by turning on the water supply valve 113 in the off state, and obtain the information regarding the temperature of the wash water as the diagnosis information using the temperature sensor 120-3, while the wash water is supplied to the spin basket 20.

If the washing machine 100 includes the heater 116, the processor 140 may check abnormality of the heater 116 (S433). For example, the processor 140 may control the heater 116 to heat the wash water filled in the spin basket 20, while the wash water is supplied to the spin basket 20, and obtain information regarding abnormality of the heater 116 as the diagnosis information by receiving a feedback signal from the heater 116 or detecting a temperature change of the wash water filled in the spin basket 20 using the temperature sensor 120-3.

In addition, the processor 140 may determine a water level of the wash water filled in the spin basket 20 using the water level sensor 120-4 included in the sensor 120 while the wash water is supplied to the spin basket 20, and obtain information regarding a flow rate of the wash water supplied to the spin basket 20 based on a change of the water level over time (S435). The information regarding the flow rate of the wash water may include a water supply rate of each of hot water or cold water, a water supply rate per time, and the like.

In this case, the processor 140 may provide the state and additional information of the water supply pipe 30 to the user based on the information regarding the flow rate of the wash water. For example, the processor 140 may control the display 130 to display the state of the water supply pipe 30 (foreign material clogging, suitability of connection of the water supply pipe 30, and the like) and the additional information thereof (whether the water supply pipe 30 needs to be inspected or replaced) or control the communication interface 160 to transmit these to an external device, by comparing changes in water supply rate or water supply rate per time.

In addition, the processor 140 may obtain information regarding water supply time based on the information regarding the flow rate of order of steps the wash water. For example, the processor 140 may obtain water supply time (min) by dividing the water supply rate per time (l/min) by the amount of the wash water to be supplied (l). The water supply time of the wash water to be supplied to the spin basket 20 may be one factor configuring washing completion time, when the washing machine 100 performs a specific course (e.g., washing course or the like) including the water supply process.

In the above description, the processor 140 may perform each operation in the order of Steps S431, S433, and S435, but this is merely an embodiment, and the operations may be performed in a different order or at the same time. For example, the processor 140 may obtain the information regarding the temperature of the wash water using the temperature sensor 120-3 before the wash water is supplied to the spin basket 20, and in this case, the temperature sensor 120-3 may be installed at each water supply valve 113 for hot water or cold water.

The processor 140 may detect a water level (or amount) of the wash water supplied to the spin basket 20 using the water level sensor 120-4 included in the sensor 120 and control the water supply valve 113 to be closed by changing the on state of the water supply valve 113 to the off state, if the water level of the wash water supplied to the spin basket 20 reaches a predetermined water level, thereby stopping the supply of the wash water. The predetermined water level may be determined according to the capacity of the spin basket 20 and may be, for example, a maximum water level of the spin basket 20.

Next, the processor 140 may control the driving unit 110 to rotate the spin basket 20 filled with the wash water as a cleaning process (S450). In this case, the processor 140 may control the driving unit 110 to rotate the spin basket 20 and/or the pulsator of the washing machine 100. The part overlapped with Step S350 will not be repeated.

In this case, the driving unit 110 may include the motor 112 for rotating the spin basket 20, and the processor 140 may obtain information regarding abnormality of the motor 112 based on a rotation rate of the motor 112 for rotating the spin basket 20 filled with the wash water (S451).

Specifically, the processor 140 may transmit a control signal for rotating the spin basket 20 at a specific rotation rate (e.g., RPM) to the motor 112 as a reference input signal. The specific rotation rate may refer to a rotation rate suitable for the cleaning process for cleaning the spin basket 20. For example, the specific rotation rate may change over time.

In this case, the processor 140 may receive a feedback signal from the motor 112 detected using the speed sensor 120-1 while the spin basket 20 rotates at a specific rotation rate (e.g., RPM) and determine the rotation rate of the motor 112 from the received feedback signal.

The processor 140 may obtain information regarding abnormality of the motor 112 by comparing the control signal and the feedback signal. In addition, if the washing machine 100 includes a clutch connected to the motor 112, the processor 140 may obtain information regarding abnormality of the clutch by comparing the control signal and the feedback signal.

Next, if the rotation of the spin basket 20 is completed, the processor 140 may drain the wash water filled in the spin basket 20 as the drainage process (S470). The part overlapped with Step S370 will not be repeated.

In this case, when the rotation of the spin basket 20 is completed, the processor 140 may obtain information regarding whether the drain valve 114 is normally operated using the valve sensor 120-11 (S471), and if the drain valve 114 is normally operated, the processor 140 may drain the wash water from the spin basket 20 by turning on the drain valve 114 in the off state, determine the water level of the spin basket 20 according to the drainage of the wash water using the water level sensor 120-4, and obtain information regarding a flow rate of the wash water draining from the spin basket 20 based on a change of the water level over time (S473).

Specifically, when the rotation of the spin basket 20 is completed, the processor 140 may obtain information regarding whether the drain valve 114 is normally operated as the diagnosis information according to a signal detected by a circuit included in the drain valve 114 using the valve sensor 120-11. If the washing machine 100 includes the pump 115, the processor 140 may obtain information regarding abnormality of the pump 115 using the sensor 120.

If the drain valve 114 is normally operated, the processor 140 may drain the wash water from the spin basket 20 to the outside of the washing machine 100 by turning on the drain valve 114 in the off state. If the washing machine 100 includes the pump 115 and the pump is normally operated, the processor 140 may control the pump 115 to drain the wash water of the spin basket 20 outside of the washing machine 100.

The processor 140 may determine the water level (or amount of water) of the spin basket 20 according to the drainage of the wash water using the water level sensor 120-4 while the wash water drains from the spin basket 20, and obtain information regarding a flow rate of the wash water draining from the spin basket 20 based on a change of the water level over time. The information regarding the flow rate of the wash water may include a drainage rate of the wash water draining from the spin basket 20, a drainage rate thereof per time, and the like.

In this case, the processor 140 may provide the state and additional information of the drain pipe 40 to the user based on the information regarding the flow rate of the wash water. For example, the processor 140 may control the display 130 to display the state of the drain pipe 40 or the pump 115 (foreign material clogging, suitability of connection of the drain pipe 40 or the pump 115, and the like) and the additional information thereof (whether the drain pipe 40 or the pump 115 needs to be inspected or replaced) or control the communication interface 160 to transmit these to an external device, by comparing changes in drainage rate or drainage rate per time.

In addition, the processor 140 may obtain information regarding drainage time based on the information regarding the flow rate of the wash water. For example, the processor 140 may obtain drainage time (min) by dividing the drainage rate per time (l/min) by the amount of the wash water to drain (l). The drainage time of the wash water draining from the spin basket 20 may be one factor configuring the washing completion time, when the washing machine 100 performs a specific course (e.g., washing course or the like) including the drainage process.

Next, after the wash water drains from the spin basket 20, the processor 140 may control the driving unit 110 to rotate the spin basket 20 as the dehydration process (S490). The part overlapped with Step S390 will not be repeated.

In this case, the processor 140 may control the motor 112 to rotate the spin basket 20 after the wash water drains from the spin basket 20 in the cleaning course, determine a rotation rate of the motor 112 using the speed sensor 120-1 while the spin basket 20 rotates, and obtain information regarding abnormality of the motor 112 based on the rotation rate of the motor 112 and information regarding vibration of the washing machine 100, when the rotation rate of the motor 112 is equal to or higher than a predetermined value.

Specifically, the processor 140 may transmit a control signal for rotating the spin basket 20 at a specific rotation rate (e.g., RPM) to the motor 112 as the reference input signal. The specific rotation rate herein may refer to a high rotation rate to be suitable to the dehydration process for removing moisture using a centrifugal force. For example, the specific rotation rate may be a rotation rate higher than the rotation rate in the cleaning process.

In this case, the processor 140 may receive the feedback signal from the motor 112 detected using the speed sensor 120-1 while the spin basket 20 rotates at a specific rotation rate (e.g., RPM) and determine the rotation rate of the motor 112 from the received feedback signal (S491).

The processor 140 may obtain information regarding abnormality of the motor 112 by comparing the control signal and the feedback signal. The control signal may be a signal corresponding to a target speed and the feedback signal may refer to a signal corresponding to an output speed.

In addition, the processor 140 may obtain the information regarding the vibration of the washing machine 100 when the rotation rate is equal to or higher than a predetermined value (S493). For example, if the rotation rate of the motor 112 determined based on the feedback signal detected using the speed sensor is equal to or higher than a predetermined value (e.g., 120 RPM), the processor 140 may obtain the information regarding the vibration of the washing machine 100 using the vibration sensor. For this, the vibration sensor may be attached to various positions such as a lower part, an upper part, a front part, a rear part, a side part, and the like of the washing machine 100 to detect the vibration at each position.

In this case, the processor 140 may obtain information regarding a horizontal state (or horizontal balance) of the washing machine 100 based on the rotation rate of the motor 112 and the information regarding the vibration of the washing machine 100 (S493). The processor 140 may display notification information for notifying a position of a leg of the washing machine, the height of which is required to be adjusted, among a plurality of legs (not shown) of the washing machine to the user, or transmit the notification information to an external device, based on the information regarding the horizontal state of the washing machine 100. The plurality of legs of the washing machine may be formed on a lower portion of the washing machine 100 at positions different from each other and may refer to elements having an adjustable height so that the washing machine 100 is horizontally supported.

Hereinafter, a method for displaying information according to an embodiment of the disclosure will be described with reference to FIG. 6.

Figure 6:
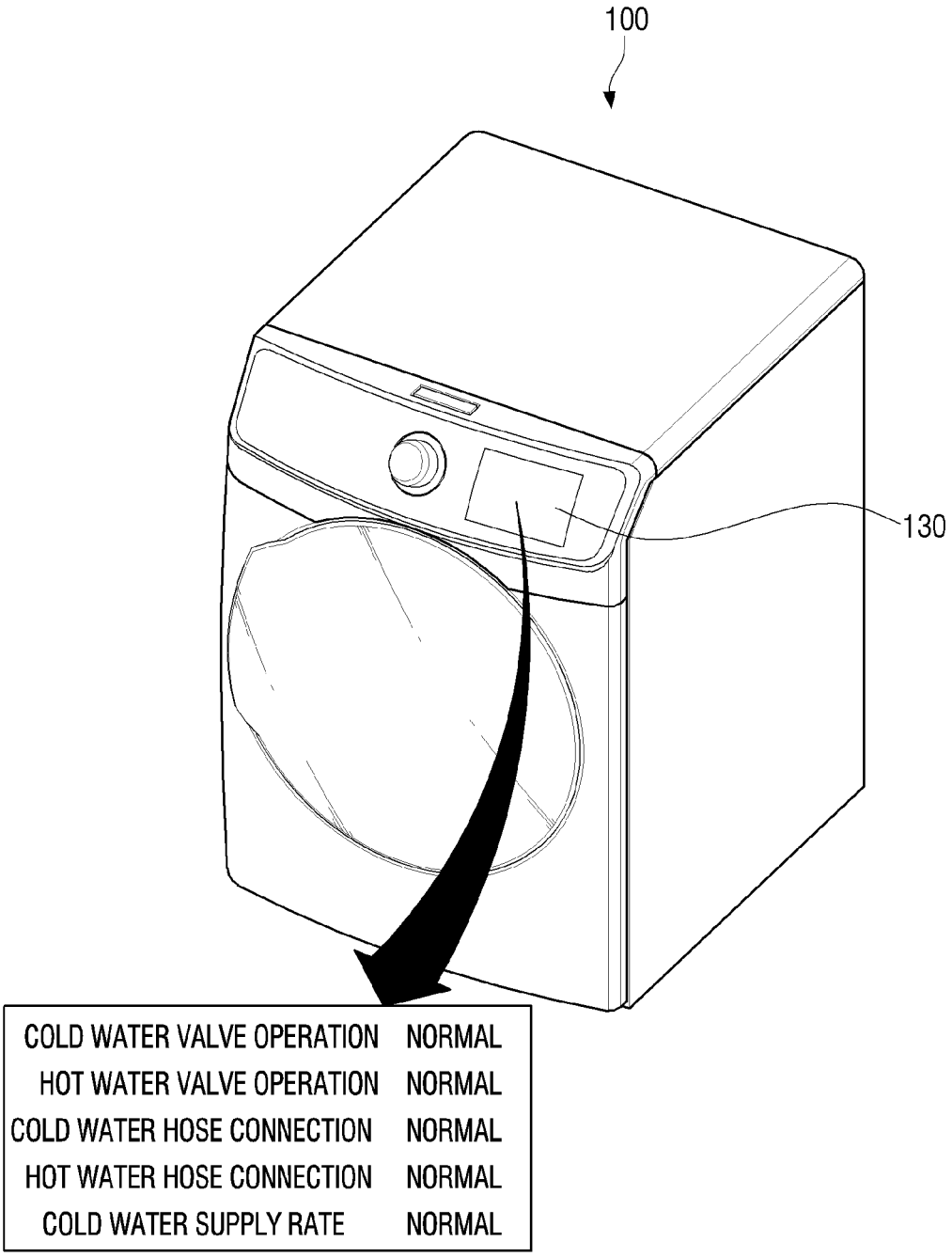
FIG. 6 illustrates a view for explaining a method for displaying information according to an embodiment.

Referring to FIG. 6, the processor 140 may control the display 130 to display the diagnosis information obtained using the sensor 120. The processor 140 may display abnormal items and normal items from the diagnosis information on the display 130 to be visually distinguished (e.g., flash, color, or the like). In addition, the processor 140 may display information regarding detailed description or fixing method for the abnormal item from the diagnosis information (e.g., text, image, video, or the like) on the display.

Hereinafter, a method for displaying the information according to an embodiment of the disclosure will be described in detail with reference to FIGS. 7A and 7B.

Figure 7A:
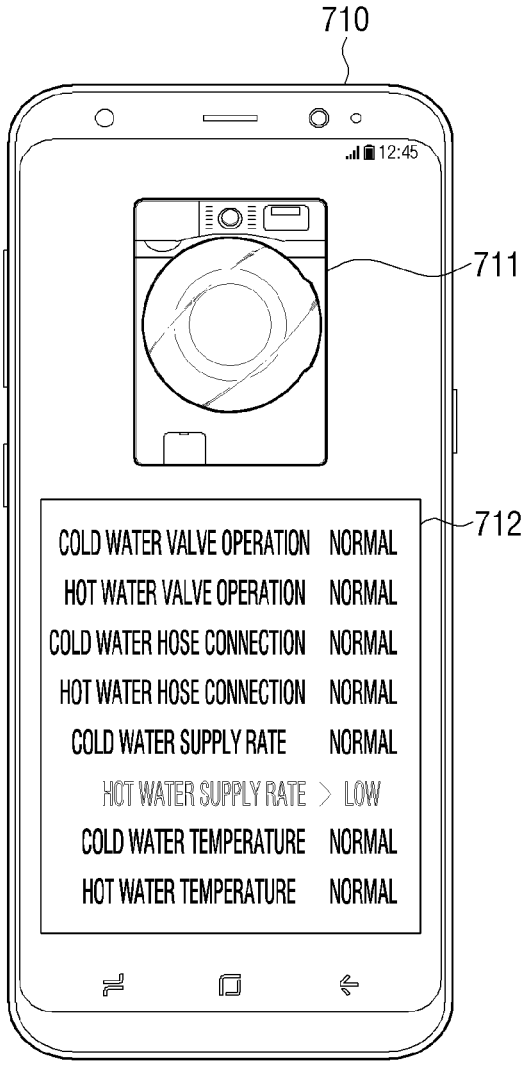
FIG. 7A illustrates a view for explaining a method for displaying information according to an embodiment.
Figure 7B:
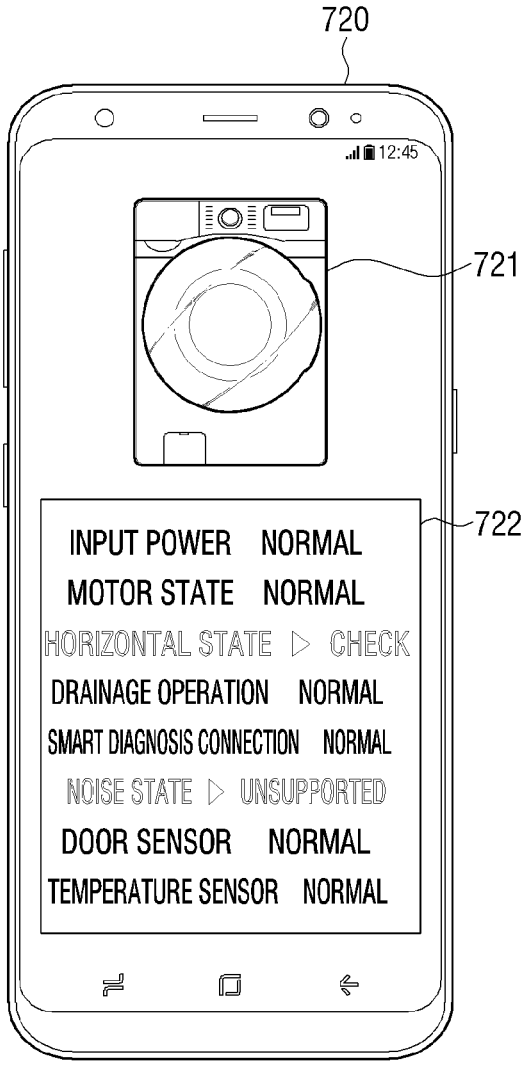
FIG. 7B illustrates a view for explaining a method for displaying information according to an embodiment.

Referring to FIGS. 7A and 7B, the washing machine 100 according to an embodiment of the disclosure may further include the communication interface 160. The processor 140 may control the communication interface 160 to transmit the obtained diagnosis information to external devices 710 and 720. The external devices 710 and 720 may be implemented as various electronic devices such as a smartphone, a server, a PC, and the like including a communication interface capable of performing communication with the washing machine 100.

In this case, the external devices 710 and 720 may display diagnosis information 712 and 722 received from the washing machine 100 on a display (not shown) of the external devices 710 and 720. The external devices 710 and 720 may display abnormal items and normal items from the diagnosis information 712 and 722 on the display to be visually distinguished. In addition, the external devices 710 and 720 may display information regarding detailed description or fixing method for the abnormal item from the diagnosis information 712 and 722 (e.g., text, image, video, or the like) on the display.

In addition, the processor 140 may control the communication interface 160 to transmit information regarding the washing machine 100 to the external devices 710 and 720. In this case, an image or a text regarding a model of the washing machine 100 may be displayed on the display based on received information 711 and 721 regarding the washing machine.

Assuming that the external device is a server of a manufacturer or the like, the processor 140 may control the communication interface 160 to transmit the obtained diagnosis information to the external devices 710 and 720 with user consent. In this case, the manufacturer may more easily and systematically manage the history of the washing machine used by the user and provide rapid and efficient solutions and repair services regarding reasons for errors/breakdown of the washing machine including a plurality of various components, thereby reducing cost relating thereto.

The washing machine 100 according to an embodiment of the disclosure may provide regular notification to regularly clean the spin basket 20 and obtain the diagnosis information.

Specifically, the processor 140 may control the display 130 to display notification suggesting to perform the smart management function or control the communication interface 160 to transmit the notification to an external device, if the number of times of the washing course for washing the laundry performed after performing the smart management function is equal to or higher than a predetermined number of times (e.g., 20 times), or after a predetermined period of time (e.g., 1 month) has elapsed after performing the smart management function.

Hereinafter, the diagnosis information according to an embodiment of the disclosure will be described with reference to FIG. 8.

Referring to FIG. 8, when the cleaning course is performed several times, the processor 140 according to an embodiment of the disclosure may obtain diagnosis information for each cleaning course, divide the obtained diagnosis information for each time when the cleaning course is performed, and store the diagnosis information in the washing machine 100.

Specifically, the processor 140 may store the diagnosis information such as date and time 820 when the cleaning course is performed, a flow rate 830 of the wash water supplied to the spin basket 20, a weight 840 of the spin basket 20, a flow rate 850 of the wash water draining from the spin basket 20, a course 860 most frequently used among the courses performed by the washing machine 100, an error code 870, and information 880 regarding the opened or closed state of the door 12, which are divided for each time the cleaning course is performed, in the memory 150.

In addition, when a user command for obtaining the diagnosis information is received, the processor 140 may control the display 130 to display the diagnosis information stored in the memory 150 for each time when the cleaning course is performed or control the communication interface 160 to transmit the diagnosis information to an external device.

The processor 140 may match the diagnosis information with information 810 regarding the washing machine 100 stored in the washing machine 100 in advance and store these in the washing machine 100. The information 810 regarding the washing machine 100 may include a device ID (model of the washing machine 100 or the like) and installation date when the washing machine 100 is installed.

As described above, the washing machine 100 according to an embodiment of the disclosure may have improved accuracy regarding the weight detection of the laundry through weight detection of the spin basket 20 of the washing machine 100.

In addition, the washing machine 100 of the disclosure may have improved accuracy regarding estimated washing time of the laundry through measurement of the flow rate of the wash water.

Further, the washing machine 100 of the disclosure may provide the diagnosis information with improved accuracy and reliability to the user, since the diagnosis information is obtained while performing the operations (water supply, rotation, drainage, dehydration, and the like) of the cleaning course in the standard state where the laundry is absent.

The washing machine 100 according to an embodiment of the disclosure may be controlled by an external device. Hereinafter, this will be described in detail with reference to FIGS. 9A to 9D.

Referring to FIGS. 9A to 9D, an external device 900 may control the washing machine 100. The external device 900 may be implemented as various electronic devices, for example, a smartphone, a tablet PC, a PC, a remote controller, a server, and the like.

In this case, the external device 900 may include a processor (not shown) which controls general operations of the external device 900, a display (not shown) for displaying information, a communication interface (not shown) which performs communication with another external device such as the washing machine 100, a memory (not shown) storing the information, an input interface (not shown) which receives (or inputs) user commands (e.g., user's voice, a motion, a touch input, eye tracking, hovering, a button input, a mouse/keyboard input, a remote controller input, and the like), and the like. The description regarding each element of the washing machine 100 illustrated in FIG. 2B may be applied to the each element of the external device 900 in the same manner, and therefore the overlapped description will not be repeated.

Specifically, when a user command for executing an application for controlling the washing machine 100 is received, the external device 900 may execute an application controlling the washing machine 100 and display a first user interface (UI) of the application on a display of the external device 900. The first UI according to an embodiment of the disclosure is assumed as a UI illustrated in FIG. 9A.

Figure 9A:
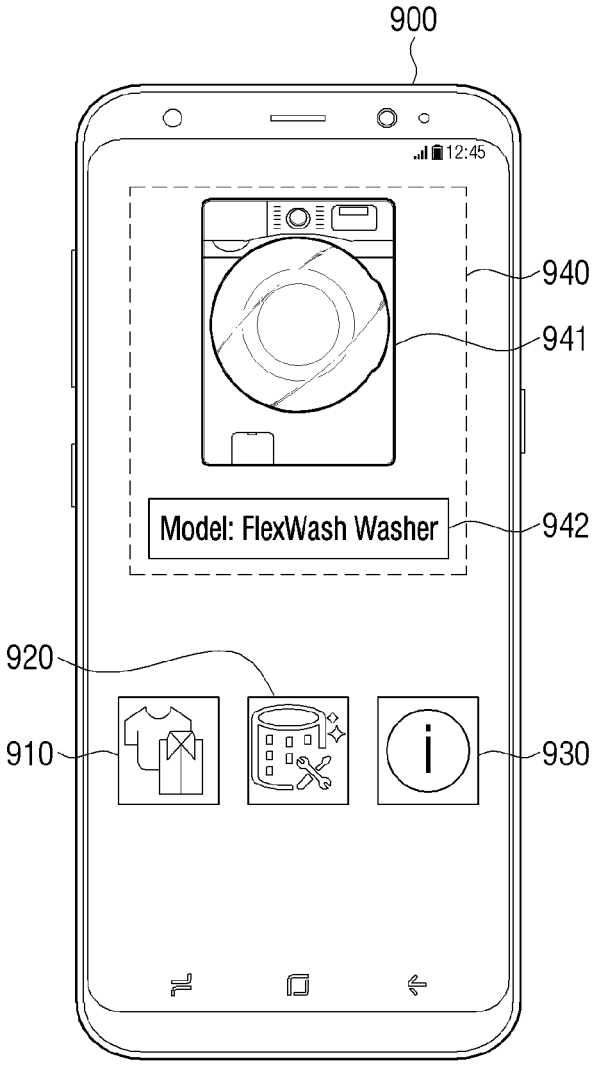
FIG. 9A illustrates a view for explaining a method for controlling the washing machine according to an embodiment.

Referring to FIG. 9A, the first UI displayed on the external device 900 may include a plurality of menus 910, 920, and 930 to be selected by a user. In this case, if the user selects any one of the plurality of menus 910, 920, and 930, the external device 900 may perform a specific operation corresponding to the selected menu.

For this, the specific operation may be set to each of the plurality of menus 910, 920, and 930. For example, an operation of displaying a UI for controlling a washing function (or washing course) of the washing machine 100 may be set to the first menu 910, an operation of displaying a UI for controlling the smart management function of the washing machine 100 may be set to the second menu 920, and an operation of displaying the diagnosis information may be set to the third menu 930. However, this is merely an embodiment, and other operations may be set to the plurality of the menus 910, 920, and 930, respectively. In addition, the plurality of the menus 910, 920, and 930 are illustrated as images in FIG. 9A, but this is merely an embodiment, and these may be implemented in various forms such as a text, a symbol, a video, and the like.

In addition, the first UI displayed on the external device 900 may include information 940 regarding the washing machine 100. For example, the information 940 regarding the washing machine 100 may include an image 941 corresponding to the model of the washing machine 100, information 942 regarding the washing machine 100 (e.g., model name or the like), function information (not shown) (e.g., information regarding useful function or state of the washing machine 100 or the like), as the information regarding the washing machine 100 controlled by the external device 900.

Hereinafter, a case where the user selects the second menu 920 will be described in detail.

In an embodiment, when a user command for selecting the second menu 920 on the first UI is received, the external device 900 may display a second UI corresponding to the second menu 920 on the display of the external device 900. The second UI corresponding to the second menu 920 may be a UI for controlling the smart management function. Hereinafter, the second UI according to an embodiment of the disclosure may be assumed as a UI illustrated in FIG. 9B.

Figure 9B:
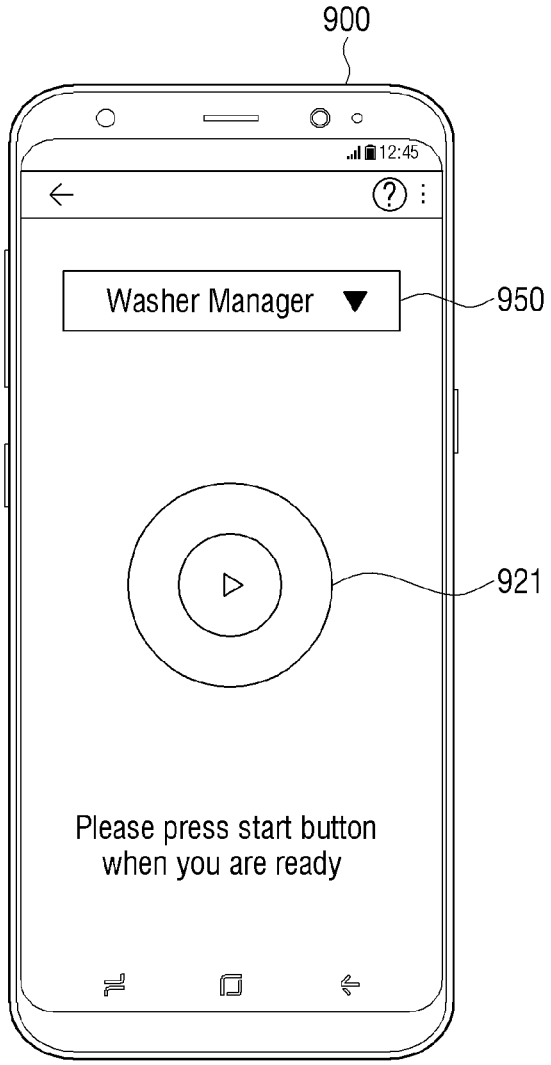
FIG. 9B illustrates a view for explaining a method for controlling the washing machine according to an embodiment.

Referring to FIG. 9B, the second UI displayed on the external device 900 may include a start button 921 and a menu change button 950 selectable by a user.

The start button 921 may refer to a button for the washing machine 100 to perform the smart management function. For example, when a user command for selecting the start button 921 is received, the external device 900 may transmit the user command for the washing machine 100 to perform the smart management function to the washing machine 100, and the washing machine 100 may perform the smart management function according to an embodiment of the disclosure in accordance with the received user command (S310, S410).

The menu change button 950 may refer to a button for changing the UI to a UI corresponding to another menu among the plurality of menus 910, 920, and 930, when the menu change button 950 is selected. For example, when a user command for selecting the menu change button 950 is received, the external device 900 may display a text (or image) regarding the plurality of menus 910, 920, and 930 on the second UI, and when a user command for selecting one of the plurality of menus 910, 920, and 930 is received, the external device 900 may change the UI to a UI corresponding to the menu (text) selected on the second UI and display the UI on the display of the external device 900. However, this is merely an embodiment, and the menu change button 950 may be realized in various forms such as a drop down list, a combo box, a radio button, a check box, and the like.

Hereinafter, a case where the user selects the start button 921 will be described in detail.

In an embodiment, when a user command for selecting the start button 921 is received, the external device 900 may transmit the user command for the washing machine 100 to perform the smart management function to the washing machine 100, and display a third UI for notifying a user that the washing machine 100 is performing the smart management function on the display of the external device 900. Hereinafter, the third UI according to an embodiment of the disclosure is assumed as a UI illustrated in FIG. 9C.

Figure 9C:
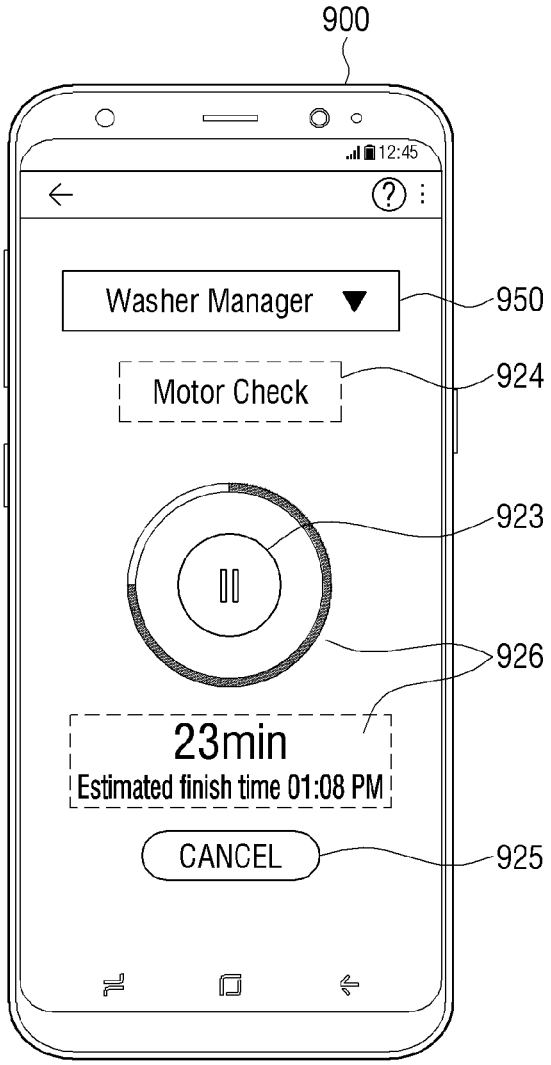
FIG. 9C illustrates a view for explaining a method for controlling the washing machine according to an embodiment.

Referring to FIG. 9C, the third UI displayed on the external device 900 may include a pause button 923 and a cancel button 925 selectable by the user, and may also include a progress information 924, progress time information 926, and the menu change button 950.

The pause button 923 (e.g., ||) may refer to a button for temporarily stopping the operation (e.g., smart management function or the like) being performed by the washing machine 100. For example, when a user command for selecting the pause button 923 is received, the external device 900 may transmit the user command for stopping the smart management function being performed by the washing machine 100 to the washing machine 100. In this case, the washing machine 100 may stop the smart management function in accordance with the received user command. The external device 900 may change the pause button 923 to a restart button (not shown, e.g., ►) and display the restart button, and when a user command for selecting the restart button is received, the external device 900 may control the washing machine 100 so that the washing machine 100 may restart and perform the stopped operation again.

The cancel button 925 may refer to a button for entirely canceling the operation being performed by the washing machine 100. For example, when a user command for selecting the cancel button 925 is received, the external device 900 may transmit the user command for canceling the smart management function being performed by the washing machine 100 to the washing machine 100 and display the UI as in FIG. 9B on the display again. In this case, the washing machine 100 may cancel the smart management function in accordance with the received user command.

The progress information 924 may include information regarding the operation currently executed by the washing machine. For example, when the washing machine 100 performs the operation of checking the motor (S451), the external device 900 may display information such as "checking for motor", "diagnosing motor", and the like as the progress information 924 on the display of the external device 900.

The progress time information 926 may include time when the washing machine 100 has performed the operation (e.g., 11:40 AM), estimated time when the operation being performed by the washing machine 100 is to be completed (e.g., 01:08 PM), remaining time until the completion of the operation being performed by the washing machine 100 (e.g., 23 min), a degree of completion of the operation performed by the washing machine 100 (e.g., 75%), a remaining degree until the completion of the operation being performed by the washing machine 100 (e.g., 25%), and the like. The progress time information 926 may be realized in various forms such as a number, a text, a symbol, a progress bar such as a bar or a circle, and the like.

In an embodiment, when the washing machine 100 completes the operation (e.g., smart management function), the external device 900 may display a completion message (not shown) for notifying this on the display of the external device 900.

Figure 9D:
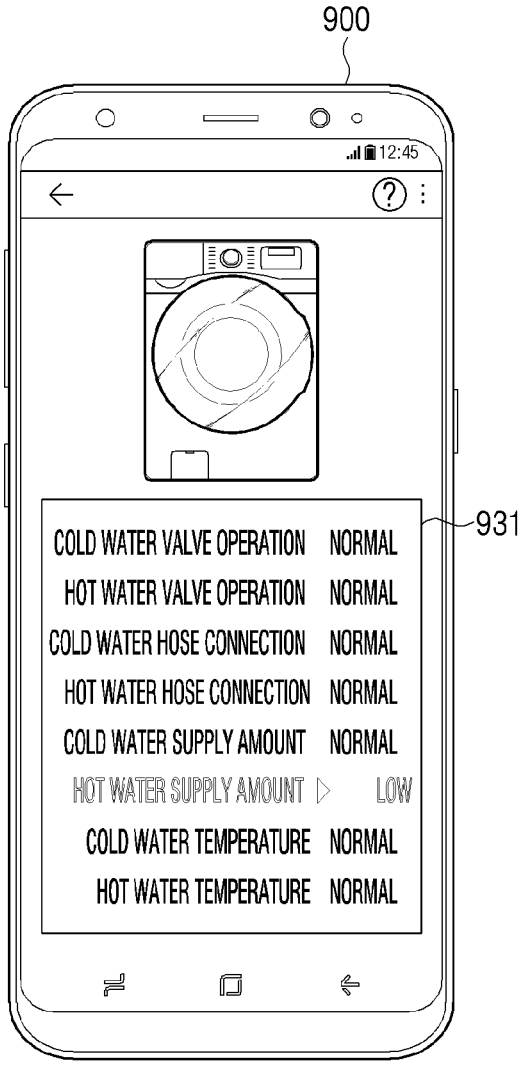
FIG. 9D illustrates a view for explaining a method for controlling the washing machine according to an embodiment.

In addition, referring to FIG. 9D, when the washing machine 100 completes the operation (e.g., smart management function), the external device 900 may display diagnosis information 931 obtained while the washing machine 100 performs the cleaning function on the display of the external device 900. For this, the external device 900 may receive the diagnosis information 931 from the washing machine 100 and store the diagnosis information 931 in the external device 900. The description with reference to FIGS. 7A and 7B may be applied in the same manner, and therefore the overlapped description regarding this will not be repeated.

The external device 900 for controlling the washing machine 100 illustrated in FIGS. 9A to 9D may be the same as or different from the external devices 710 and 720 for providing the information received from the washing machine 100 illustrated in FIGS. 7A and 7B.

The external device 900 may need a control authority to control an application for controlling the washing machine 100 or the washing machine 100. For this, the external device 900 may receive an application for controlling the washing machine 100 from an application store (e.g., GALAXY APPS™, PLAY STORE™, or APP STORE™), a cloud server, or the washing machine 100 and install this on the external device 900. However, this is merely an embodiment, and the external device 900 may install the application through various paths or methods. In addition, the external device 900 may have control authority for controlling the washing machine 100 according to various methods such as pairing, a QR code, Wi-Fi Direct, WPS, server authentication, and the like.

Figure 10:
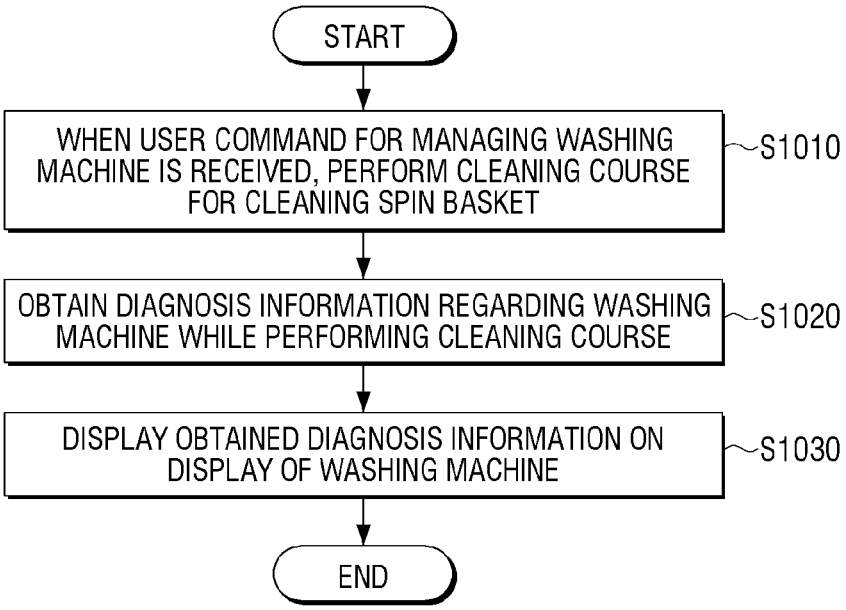
FIG. 10 illustrates a view for explaining a flowchart according to an embodiment.

FIG. 10 illustrates a view for explaining a flowchart according to an embodiment of the disclosure.

Referring to FIG. 10, a method for controlling the washing machine 100 according to an embodiment of the disclosure may include, based on a user command (or user input) for managing the washing machine 100 being received, performing a cleaning course for cleaning the spin basket 20, obtaining diagnosis information regarding the washing machine 100 while performing the cleaning course, and displaying the obtained diagnosis information on the display 130 of the washing machine 100.

Specifically, when a user command for managing the washing machine 100 is received, a cleaning course for cleaning the spin basket 20 may be performed (S1010). The performing the cleaning course may include supplying wash water to the spin basket 20 and rotating the spin basket 20 filled with the wash water.

The diagnosis information regarding the washing machine 100 may be obtained while performing the cleaning course (S1020). The diagnosis information herein may include at least one piece of information from information indicating a weight of the spin basket 20, abnormality of the water supply valve 113 for supplying the wash water to the spin basket, a temperature of the wash water supplied to the spin basket, a flow rate of the wash water supplied to the spin basket 20, abnormality of the motor 112, abnormality of the drain valve 114 for draining the wash water, a flow rate of the wash water draining from the spin basket 20, and vibration of the washing machine.

The control method according to an embodiment of the disclosure may further include detecting the weight of the spin basket 20 before supplying the wash water to the spin basket 20, and based on the laundry being determined to be absent in the spin basket 20 based on the detected weight, obtaining the detected weight as the diagnosis information. The detected weight herein may be used to detect the weight of the laundry when washing the laundry.

The control method according to an embodiment of the disclosure may further include obtaining information regarding whether the water supply valve 113 is normally operated, based on the water supply valve 113 being normally operated, turning on the water supply valve 113 in the off state and supplying the wash water to the spin basket 20, and obtaining information regarding a temperature of the wash water while the wash water is supplied to the spin basket 20.

The control method according to an embodiment of the disclosure may further include determining a water level of the wash water filled in the spin basket 20 while the wash water is supplied to the spin basket 20, and obtaining information regarding a flow rate of the wash water supplied to the spin basket 20 based on a change of the water level over time.

The control method according to an embodiment of the disclosure may further include obtaining information regarding abnormality of the motor 112 based on a rotation rate of the motor 112 of the washing machine 100 for rotating the spin basket 20 filled with the wash water.

The control method according to an embodiment of the disclosure may further include, based on a rotation of the spin basket 20 being completed, obtaining information regarding whether the drain valve 114 is normally operated, based on the drain valve 114 being normally operated, turning on the drain valve 114 in an off state, draining the wash water from the spin basket 20, and determining a water level of the spin basket 20 according to the drainage of the wash water, and obtaining information regarding a flow rate of the wash water draining from the spin basket 20 based on a change of the water level over time.

The control method according to an embodiment of the disclosure may further include rotating the spin basket 20 after the wash water is drained from the spin basket 20 in the cleaning course, determining a rotation rate of the motor 112 while the spin basket 20 is rotated, and obtaining information regarding the abnormality of the motor 112 based on the rotation rate of the motor 112 and information regarding vibration of the washing machine, based on the rotation rate of the motor 112 being equal to or higher than a predetermined value.

The control method according to an embodiment of the disclosure may further include, based on the cleaning course being performed a plurality of times, obtaining diagnosis information for each cleaning course, and dividing the obtained diagnosis information for each time when the cleaning course is performed and storing the diagnosis information in a memory of the washing machine.

Next, the obtained diagnosis information may be displayed on the display 130 of the washing machine (S1030).

The control method according to an embodiment of the disclosure may further include transmitting the obtained diagnosis information to an external device. In this case, the external device may display the received diagnosis information on the display 130 or transmit the diagnosis information to another external device to display the diagnosis information.

The method for controlling the washing machine 100 according to an embodiment of the disclosure may obtain diagnosis information for diagnosing whether the washing machine 100 normally performs each operation performed in the cleaning course, while performing the cleaning course for maintaining the inside of the washing machine 100 clean by removing a detergent, contaminants, bacteria, or mold remaining in the washing machine 100, and provide the obtained diagnosis information to the user.

Accordingly, in the control method of the washing machine 100 of the disclosure, the washing machine 100 of the disclosure may diagnose and manage by itself using energy (water, electric power, time, and the like) consumed in this process while maintaining the inside of the washing machine 100 clean by performing a smart management function, thereby improving energy efficiency.

In the control method of the washing machine 100 of the disclosure, it is possible to maintain and manage the washing machine 100 at an optimal state by storing and using the diagnosis information, thereby reducing cost thereof.

In the control method of the washing machine 100 of the disclosure, it is possible to improve accuracy of the diagnosis information regarding the self-diagnosis, since the smart management function is performed in a state where the laundry is absent in the spin basket 20 of the washing machine 100.

In the control method of the washing machine 100 of the disclosure, it is possible to improve accuracy regarding the weight detection of the laundry through the weight detection regarding the spin basket 20 of the washing machine 100.

In the control method of the washing machine 100 of the disclosure, it is possible to improve accuracy regarding estimated washing time of the laundry through the measurement of the flow rate of the wash water.

According to the embodiments of the disclosure, a washing machine which maintains the inside of the washing machine 100 clean and performs self-diagnosis by performing the smart management function, and a method for controlling thereof may be provided.

The washing machine 100 of the disclosure may maintain and manage the washing machine 100 at an optimal state using the diagnosis information, thereby reducing cost thereof.

In the washing machine 100 of the disclosure, it is possible to improve accuracy of the diagnosis information regarding the result obtained by self-diagnosis.

In the washing machine 100 of the disclosure, it is possible to improve accuracy regarding the weight detection of the laundry through the weight detection regarding the spin basket of the washing machine 100.

In the washing machine 100 of the disclosure, it is possible to improve accuracy regarding estimated washing time of the laundry through the measurement of the flow rate of the washing machine.

Various embodiments of the disclosure may be implemented as software including instructions stored in machine (e.g., computer)-readable storage media. The machine is a device which invokes instructions stored in the storage medium and is operated according to the invoked instructions, and may include an electronic device (e.g., washing machine 100) according to the disclosed embodiments. In a case where the instruction is executed by a processor, the processor may execute a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

The methods according to various embodiments may be provided to be included in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

Each of the elements (e.g., a module or a program) according to various embodiments described above may include a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to integration. Operations performed by a module, a program, or other elements, in accordance with various embodiments, may be performed sequentially, in a parallel, repetitive, or heuristically manner, or at least some operations may be performed in a different order, omitted, or may add a different operation.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising a spin basket, the washing machine comprising:

a water supply valve;

a driving unit configured to rotate the spin basket;

a plurality of sensors configured to detect performance of the washing machine;

a display configured to display information; and a processor configured to:

based on a user command for managing the washing machine being received, perform a cleaning course for cleaning the spin basket by controlling the water supply valve to supply wash water to the spin basket in a state where the spin basket does not accommodate laundry and by controlling the driving unit to rotate the spin basket filled with the wash water, obtain diagnosis information regarding the washing machine using the plurality of sensors while the cleaning course of the spin basket is performed where the spin basket does not accommodate the laundry, at least some of the diagnosis information obtained by at least two of the plurality of sensors after the wash water has been supplied to the spin basket, and display the obtained diagnosis information on the display, wherein the diagnosis information comprises information regarding the performance of the washing machine.

2. The washing machine according to claim 1, wherein the diagnosis information comprises at least one piece of information from information indicating:

a weight of the spin basket;

a temperature of the wash water supplied to the spin basket;

a flow rate of the wash water supplied to the spin basket;

a flow rate of the wash water draining from the spin basket; and vibration of the washing machine.

3. The washing machine according to claim 2, wherein:

at least one of the plurality of sensors comprises a weight sensor configured to detect the weight of the spin basket, the processor is further configured to:

detect the weight of the spin basket using the weight sensor before supplying the wash water to the spin basket, and based on the laundry being determined to be absent in the spin basket based on the detected weight, obtain the detected weight as the diagnosis information, and the detected weight is used to detect a weight of the laundry when washing the laundry.

4. The washing machine according to claim 2, wherein:

at least one of the plurality of sensors comprises a valve sensor configured to detect an operation of the water supply valve and a temperature sensor for detecting the temperature of the wash water, and the processor is further configured to:

obtain information regarding whether the water supply valve is operated using the valve sensor, based on the water supply valve being operated, turn on the water supply valve in an off state and supply the wash water to the spin basket, and obtain information regarding the temperature of the wash water using the temperature sensor while the wash water is supplied to the spin basket.

5. The washing machine according to claim 2, wherein:

at least one of the plurality of sensors comprises a water level sensor configured to detect a water level of the filled wash water, and the processor is further configured to:

determine the water level of the wash water filled in the spin basket using the water level sensor while the wash water is supplied to the spin basket, and obtain information regarding the flow rate of the wash water supplied to the spin basket based on a change of the water level over time.

6. The washing machine according to claim 2, wherein:

the driving unit comprises a motor configured to rotate the spin basket, at least one of the plurality of sensors comprises a speed sensor configured to detect a rotation rate of the motor, and the processor is further configured to obtain information regarding abnormality of the motor based on the rotation rate of the motor detected using the speed sensor while rotating the spin basket filled with the wash water.

7. The washing machine according to claim 2, wherein:

at least one of the plurality of sensors comprises a valve sensor configured to detect an operation of a drain valve and a water level sensor configured to detect a water level of the filled wash water, and the processor is further configured to:

based on a rotation of the spin basket being completed, obtain information regarding whether the drain valve is operated using the valve sensor, based on the drain valve being operated, turn on the drain valve in an off state and drain the wash water from the spin basket, determine the water level of the spin basket according to the draining of the wash water using the water level sensor, and obtain information regarding the flow rate of the wash water draining from the spin basket based on a change of the water level over time.

8. The washing machine according to claim 2, wherein:

the driving unit comprises a motor configured to rotate the spin basket, at least one of the plurality of sensors comprises a speed sensor configured to detect a rotation rate of the motor and a vibration sensor configured to detect the vibration of the washing machine, and the processor is further configured to:

control the motor to rotate the spin basket after the wash water drains from the spin basket in the cleaning course, determine the rotation rate of the motor using the speed sensor while the spin basket rotates, and obtain information regarding abnormality of the motor based on the rotation rate of the motor and information regarding vibration of the washing machine, based on the rotation rate of the motor being equal to or higher than a predetermined value, using the vibration sensor.

9. The washing machine according to claim 1, further comprising a memory, wherein the processor is configured to:

based on the cleaning course being performed a plurality of times, obtain the diagnosis information for each cleaning course, and store the obtained diagnosis information in the memory for each cleaning course with each time, the cleaning course is performed.

10. The washing machine according to claim 1, further comprising a communication interface comprising circuitry, wherein the processor is further configured to control the communication interface to transmit the obtained diagnosis information to an external device.

11. A method for controlling a washing machine comprising a spin basket, the method comprising:

based on a user command for managing the washing machine being received, performing a cleaning course for cleaning the spin basket by controlling a water supply valve to supply wash water to the spin basket in a state where the spin basket does not accommodate laundry and by controlling a driving unit to rotate the spin basket filled with the wash water;

obtaining diagnosis information regarding the washing machine using a plurality of sensors while the cleaning course of the spin basket is performed where the spin basket does not accommodate the laundry, at least some of the diagnosis information obtained by at least two of the plurality of sensors after the wash water has been supplied to the spin basket; and displaying the obtained diagnosis Information on a display, wherein the performing the cleaning course comprises supplying wash water to the spin basket and rotating the spin basket filled with the wash water, and wherein the diagnosis information comprises information regarding the performance of the washing machine.

12. The method according to claim 11, wherein the diagnosis information comprises at least one piece of information from information indicating:

a weight of the spin basket;

a temperature of the wash water supplied to the spin basket;

a flow rate of the wash water supplied to the spin basket;

a flow rate of the wash water draining from the spin basket; and vibration of the washing machine.

13. The method according to claim 12, wherein:

the plurality of sensors comprises a weight sensor configured to detect the weight of the spin basket, the method further comprises:

detecting the weight of the spin basket using the weight sensor of the washing machine before supplying the wash water to the spin basket, and based on the laundry being determined to be absent in the spin basket based on the detected weight, obtaining the detected weight as the diagnosis information, and the detected weight is used to detect a weight of the laundry when washing the laundry.

14. The method according to claim 12, wherein:

the plurality of sensors comprises a valve sensor configured to detect an operation of the water supply valve and a temperature sensor configured to detect the temperature of the wash water, and the method further comprises:

obtaining information regarding whether the water supply valve is operated using the valve sensor, based on the water supply valve being operated, turning on the water supply valve in an off state and supplying the wash water to the spin basket, and obtaining information regarding the temperature of the wash water using the temperature sensor while the wash water is supplied to the spin basket.

15. The method according to claim 12, wherein:

the plurality of sensors comprises a water level sensor configured to detect a water level of the filled wash water, and the method further comprises:

determining the water level of the wash water filled in the spin basket using the water level sensor while the wash water is supplied to the spin basket, and obtaining information regarding the flow rate of the wash water supplied to the spin basket based on a change of the water level over time.

16. The method according to claim 12, wherein:

the plurality of sensors comprises a speed sensor configured to detect a rotation rate of a motor, the method further comprises obtaining information regarding abnormality of the motor based on the rotation rate of the motor detected using the speed sensor while rotating the spin basket filled with the wash water.

17. The method according to claim 12, wherein:

the plurality of sensors comprises a valve sensor configured to detect an operation of a drain valve and a water level sensor configured to detect a water level of the filled wash water, and the method further comprises:

based on a rotation of the spin basket being completed, obtaining information regarding whether the drain valve is operated using the valve sensor, based on the drain valve being operated, turning on the drain valve in an off state and draining the wash water from the spin basket and determining the water level of the spin basket according to the draining of the wash water using the water level sensor, and obtaining information regarding the flow rate of the wash water draining from the spin basket based on a change of the water level over time.

18. The method according to claim 12, wherein:

the plurality of sensors comprises a speed sensor configured to detect a rotation rate of a motor and a vibration sensor configured to detect the vibration of the washing machine, and the method further comprises:

rotating the spin basket after the wash water drains from the spin basket in the cleaning course, determining the rotation rate of the motor using the speed sensor while the spin basket rotates, and obtaining information regarding abnormality of the motor based on the rotation rate of the motor and information regarding the vibration of the washing machine, based on the rotation rate of the motor being equal to or higher than a predetermined value, using the vibration sensor.

19. The method according to claim 11, further comprising:

based on the cleaning course being performed a plurality of times, obtaining the diagnosis information for each cleaning course; and dividing the obtained diagnosis information for each time when the cleaning course is performed and store the diagnosis information in a memory of the washing machine.

20. The method according to claim 11, further comprising transmitting the obtained diagnosis information to an external device via a communication interface of the washing machine.

* * * * *